US009959801B2

(12) United States Patent
Ohara et al.

(10) Patent No.: US 9,959,801 B2
(45) Date of Patent: May 1, 2018

(54) DISPLAY DEVICE AND METHOD FOR DRIVING SAME WITH LIGHT-EMISSION ENABLE SIGNAL SWITCHING UNIT

(71) Applicant: Sharp Kabushiki Kaisha, Sakai, Osaka (JP)

(72) Inventors: Masanori Ohara, Osaka (JP); Noboru Noguchi, Osaka (JP); Noritaka Kishi, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 131 days.

(21) Appl. No.: 14/912,274

(22) PCT Filed: Jul. 22, 2014

(86) PCT No.: PCT/JP2014/069297
§ 371 (c)(1),
(2) Date: Feb. 16, 2016

(87) PCT Pub. No.: WO2015/059966
PCT Pub. Date: Apr. 30, 2015

(65) Prior Publication Data

US 2016/0210892 A1 Jul. 21, 2016

(30) Foreign Application Priority Data

Oct. 21, 2013 (JP) ..... 2013-218155

(51) Int. Cl.
*G09G 3/20* (2006.01)
*G09G 3/3258* (2016.01)
(Continued)

(52) U.S. Cl.
CPC ..... *G09G 3/2022* (2013.01); *G09G 3/2003* (2013.01); *G09G 3/3233* (2013.01);
(Continued)

(58) Field of Classification Search
CPC ... G09G 3/2022; G09G 3/2003; G09G 3/3233
See application file for complete search history.

(56) References Cited

U.S. PATENT DOCUMENTS 8,031,158 B2 * 10/2011 Jang ..... G09G 3/3677 345/100
8,299,990 B2 * 10/2012 Park ..... G09G 3/2007 345/214
(Continued)

FOREIGN PATENT DOCUMENTS

JP 2005-148749 A 6/2005
JP 2005-148750 A 6/2005
(Continued)

OTHER PUBLICATIONS

International Search Report PCT/ISA/210 for International Application No. PCT/JP2014/069297 dated Oct. 28, 2014.
(Continued)

*Primary Examiner* — Kumar Patel
*Assistant Examiner* — Richard M Russell
(74) *Attorney, Agent, or Firm* — ScienBiziP, P.C.

(57) ABSTRACT

A picture-frame size of a display device including self light-emitting type display elements which are driven by a current is reduced over conventional devices. Transistors for controlling supply of a light-emission enable signal outputted from an emission driver to emission lines are provided between the emission driver and the emission lines. In such a configuration, based on selection signals provided to the transistors, one of the transistors is brought into an on state in each subframe, and each of the transistors is brought into an on state once during one frame period.

7 Claims, 33 Drawing Sheets

(51) Int. Cl.
*G09G 3/3266* (2016.01)
*G09G 3/3233* (2016.01)

(52) U.S. Cl.
CPC ..... *G09G 3/3258* (2013.01); *G09G 3/3266* (2013.01); *G09G 2300/0443* (2013.01); *G09G 2300/0452* (2013.01); *G09G 2300/0804* (2013.01); *G09G 2310/0235* (2013.01); *G09G 2310/0286* (2013.01); *G09G 2310/0289* (2013.01); *G09G 2310/0291* (2013.01); *G09G 2310/061* (2013.01); *G09G 2310/08* (2013.01); *G09G 2320/064* (2013.01); *G09G 2330/021* (2013.01)

(56) References Cited

U.S. PATENT DOCUMENTS

2005/0104817 A1 5/2005 Kwak
2005/0104875 A1 5/2005 Kwak et al.
2005/0116656 A1* 6/2005 Shin ..... G09G 3/3233 315/169.3
2006/0262074 A1* 11/2006 Shimoda ..... G11C 19/28 345/100
2006/0279313 A1 12/2006 Fujita et al.
2008/0136964 A1 6/2008 Yamazaki
2012/0138922 A1 6/2012 Yamazaki et al.
2012/0320101 A1* 12/2012 Goden ..... G09G 3/3225 345/690
2013/0100007 A1 4/2013 Yamamoto et al.

FOREIGN PATENT DOCUMENTS

JP 2005157267 A 6/2005
JP 2006323267 A 11/2006
JP 2008145555 A 6/2008
JP 2008304573 A 12/2008
JP 2010-002755 A 1/2010
JP 2012134475 A 7/2012
WO WO-2012008186 A1 1/2012

OTHER PUBLICATIONS

Written Opinion of the International Searching Authority PCT/ISA/237 for International Application No. PCT/JP2014/069297 dated Oct. 28, 2014.

* cited by examiner

| INPUT | | OUTPUT |
|---|---|---|
| CTL2 | CTL1 | |
| 0 | 0 | EM1 |
| 0 | 1 | EM2 |
| 1 | 0 | EM3 |
| 1 | 1 | UNUSED |

DISPLAY DEVICE AND METHOD FOR DRIVING SAME WITH LIGHT-EMISSION ENABLE SIGNAL SWITCHING UNIT

TECHNICAL FIELD

The present invention relates to a display device and more particularly to a display device including self light-emitting type display elements which are driven by a current, such as an organic EL display device, and a method for driving the display device.

BACKGROUND ART

Conventionally, as display elements included in a display device, there are an electro-optical element whose luminance is controlled by a voltage applied thereto, and an electro-optical element whose luminance is controlled by a current flowing therethrough. A representative example of the electro-optical element whose luminance is controlled by a voltage applied thereto includes a liquid crystal display element. On the other hand, a representative example of the electro-optical element whose luminance is controlled by a current flowing therethrough includes an organic EL (Electro Luminescence) element. The organic EL element is also called an OLED (Organic Light-Emitting Diode). An organic EL display device using organic EL elements which are self light-emitting type electro-optical elements can easily achieve slimming down, a reduction in power consumption, an increase in luminance, etc., compared to a liquid crystal display device that requires a backlight, color filters, and the like. Therefore, in recent years, there has been active development of organic EL display devices.

As the driving system of an organic EL display device, there are known a passive matrix system (also called a simple matrix system) and an active matrix system. An organic EL display device adopting the passive matrix system is simple in structure, but is difficult to achieve size increase and definition improvement. On the other hand, an organic EL display device adopting the active matrix system (hereinafter, referred to as "active matrix-type organic EL display device") can easily achieve size increase and definition improvement, compared to the organic EL display device adopting the passive matrix system.

The active matrix-type organic EL display device has a plurality of pixel circuits formed in a matrix form. Each pixel circuit of the active matrix-type organic EL display device typically includes an input transistor that selects a pixel, and a drive transistor that controls the supply of a current to an organic EL element. Note that in the following the current flowing through the organic EL element from the drive transistor may be referred to as "drive current".

Meanwhile, in a general active matrix-type organic EL display device, one pixel is composed of three subpixels (an R subpixel that displays red, a G subpixel that displays green, and a B subpixel that displays blue). FIG. 37 is a circuit diagram showing a configuration of a conventional general pixel circuit 91 forming one subpixel. The pixel circuit 91 is provided corresponding to each of intersections of a plurality of data lines DL and a plurality of scanning signal lines SL which are disposed in a display unit. As shown in FIG. 37, the pixel circuit 91 includes two transistors T1 and T2, one capacitor Cst, and one organic EL element OLED. The transistor T1 is a drive transistor and the transistor T2 is an input transistor. Note that in the example shown in FIG. 37, the transistors T1 and T2 are n-channel thin-film transistors (TFTs).

The transistor T1 is provided in series with the organic EL element OLED. The transistor T1 is connected at its gate terminal to a drain terminal of the transistor T2, connected at its drain terminal to a power supply line that supplies a high-level power supply voltage ELVDD (hereinafter, referred to as "high-level power supply line" and denoted by the same reference character ELVDD as the high-level power supply voltage), and connected at its source terminal to an anode terminal of the organic EL element OLED. The transistor T2 is provided between the data line DL and the gate terminal of the transistor T1. The transistor T2 is connected at its gate terminal to the scanning signal line SL, connected at its drain terminal to the gate terminal of the transistor T1, and connected at its source terminal to the data line DL. The capacitor Cst is connected at its one end to the gate terminal of the transistor T1 and connected at its other end to the source terminal of the transistor T1. A cathode terminal of the organic EL element OLED is connected to a power supply line that supplies a low-level power supply voltage ELVSS (hereinafter, referred to as "low-level power supply line" and denoted by the same reference character ELVSS as the low-level power supply voltage). A connecting point among the gate terminal of the transistor T1, the one end of the capacitor Cst, and the drain terminal of the transistor T2 is hereinafter referred to as "gate node" for convenience sake. A gate-node potential is denoted by reference character VG. Note that although in general, one of the drain and source that has a higher potential is called a drain, in the description of this specification, one is defined as a drain and the other is defined as a source, and thus, a source potential may be higher than a drain potential in some cases.

FIG. 38 is a timing chart for describing the operation of the pixel circuit 91 shown in FIG. 37. Prior to time t91, the scanning signal line SL is in a non-selected state. Therefore, prior to time t91, the transistor T2 is in an off state, and the gate node potential VG keeps its initial level (e.g., a level determined according to writing performed in the preceding frame). At time t91, the scanning signal line SL goes into a selected state and thus the transistor T2 is turned on. By this, a data voltage Vdata corresponding to the luminance of a pixel (subpixel) formed by the pixel circuit 91 is supplied to the gate node through the data line DL and the transistor T2. Thereafter, during a period until time t92, the gate node potential VG changes according to the data voltage Vdata. At this time, the capacitor Cst is charged to a gate-source voltage Vgs which is the difference between the gate node potential VG and the source potential of the transistor T1. At time t92, the scanning signal line SL goes into a non-selected state. By this, the transistor T2 is turned off, and the gate-source voltage Vgs held in the capacitor Cst is fixed. The transistor T1 supplies a drive current to the organic EL element OLED, according to the gate-source voltage Vgs held in the capacitor Cst. As a result, the organic EL element OLED emits light at a luminance according to the drive current.

Meanwhile, the pixel circuit 91 shown in FIG. 37 is a circuit corresponding to one subpixel. Therefore, a configuration of a pixel circuit 910 corresponding to one pixel including three subpixels is as shown in FIG. 39. As shown in FIG. 39, the pixel circuit 910 forming one pixel is composed of a pixel circuit 91(R) for an R subpixel, a pixel circuit 91(G) for a G subpixel, and a pixel circuit 91(B) for a B subpixel. According to the configuration shown in FIG. 39, since many circuit elements are required within a pixel circuit, it is difficult to achieve definition improvement.

In view of this, Japanese Patent Application Laid-Open No. 2005-148749 discloses, as shown in FIG. 40, a pixel circuit 920 configured to further reduce the numbers of transistors and capacitors that are required for one pixel over the conventional one. The pixel circuit 920 is composed of a driving means 921, a sequential control means 922, and three organic EL elements OLED(R), OLED(G), and OLED (B). The driving means 921 is composed of a drive transistor T11, an input transistor T12, and a capacitor Cst1. The sequential control means 922 is composed of a transistor T13(R) for controlling the light emission of the red-color organic EL element OLED(R), a transistor T13(G) for controlling the light emission of the green-color organic EL element OLED(G), and a transistor T13(B) for controlling the light emission of the blue-color organic EL element OLED(B). In addition, as wiring lines for controlling the on/off of the transistors T13(R), T13(G), and T13(B), emission lines EM1, EM2, and EM3 are provided so as to pass through the pixel circuit 920.

In a configuration such as that described above, one frame period is divided into three subframes. Specifically, one frame period is divided into a first subframe for performing red light emission, a second subframe for performing green light emission, and a third subframe for performing blue light emission. Then, in the sequential control means 922, only the transistor T13(R) is brought into an on state in the first subframe, only the transistor T13(G) is brought into an on state in the second subframe, and only the transistor T13(B) is brought into an on state in the third subframe. By this, the organic EL element OLED(R), the organic EL element OLED(G), and the organic EL element OLED(B) sequentially emit light over one frame period, displaying a desired color image. In the organic EL display device disclosed in Japanese Patent Application Laid-Open No. 2005-148749, the numbers of transistors and capacitors required for one pixel are reduced in the above-described manner. Note that Japanese Patent Application Laid-Open No. 2005-148750 also discloses a pixel circuit configured to be provided with a plurality of transistors for controlling the light emission of organic EL elements for respective colors, and provided with a plurality of emission lines for controlling the on/off of the plurality of transistors.

PRIOR ART DOCUMENTS

Patent Documents

[Patent Document 1] Japanese Patent Application Laid-Open No. 2005-148749

[Patent Document 2] Japanese Patent Application Laid-Open No. 2005-148750

SUMMARY OF THE INVENTION

Problems to be Solved by the Invention

However, according to the configuration shown in FIG. 40, as components for driving the emission lines EM1, EM2, and EM3, there are required emission drivers for three systems (drive circuits that drive the emission lines). Hence, the circuit occupied area by the emission drivers increases. Accordingly, picture-frame size increases. However, in order to achieve miniaturization of a display device and an increase in the area of a display unit, there is a strong demand to reduce the picture-frame size.

An object of the present invention is therefore to reduce the picture-frame size of a display device including self light-emitting type display elements which are driven by a current, over conventional devices.

Means for Solving the Problems

A first aspect of the present invention is directed to an active matrix-type display device that performs color image display by dividing one frame period into j subframes (j is an integer greater than or equal to 3) and displaying different color screens in different subframes, the active matrix-type display device comprising:

pixel circuits arranged in a matrix form so as to form a plurality of rows and a plurality of columns, each of the pixel circuits including: j electro-optical elements configured to emit light of different colors respectively; a drive current control unit configured to control a drive current for bringing the j electro-optical elements into a light-emitting state; and j light-emission control transistors configured to control supply of the drive current to their corresponding electro-optical elements, the j light-emission control transistors being provided in a one-to-one correspondence with the j electro-optical elements;

a light-emission enable signal generating unit configured to generate a light-emission enable signal for controlling on/off states of the j light-emission control transistors;

j light-emission control lines provided for each row, the j light-emission control lines being configured to supply the light-emission enable signal to the j light-emission control transistors; and a light-emission enable signal switching unit configured to switch a supply destination of the light-emission enable signal among the j light-emission control lines in each row, such that the light-emission enable signal is supplied to different light-emission control lines indifferent subframes, the light-emission enable signal being generated by the light-emission enable signal generating unit.

According to a second aspect of the present invention, in the first aspect of the present invention, the light-emission enable signal switching unit includes:

a first control signal generating unit configured to generate a first control signal; and j light-emission enable signal supply control transistors provided for each row in a one-to-one correspondence with the j light-emission control lines, the first control signal is provided to control terminals of the j light-emission enable signal supply control transistors, first conduction terminals of the j light-emission enable signal supply control transistors are connected to the light-emission enable signal generating unit, second conduction terminals of the j light-emission enable signal supply control transistors are connected to their corresponding light-emission control lines, and the first control signal generating unit generates the first control signal such that one of the j light-emission enable signal supply control transistors goes into an on state in each subframe, and each of the j light-emission enable signal supply control transistors goes into an on state once during one frame period.

According to a third aspect of the present invention, in the second aspect of the present invention, the j light-emission control transistors and the j light-emission enable signal supply control transistors are thin-film transistors each having a channel layer formed of an oxide semiconductor.

According to a fourth aspect of the present invention, in the third aspect of the present invention, main components of the oxide semiconductor are indium (In), gallium (Ga), zinc (Zn), and oxygen (O).

According to a fifth aspect of the present invention, in the second aspect of the present invention, the light-emission enable signal generating unit includes a shift register having a plurality of stages, the shift register outputs the light-emission enable signals to the plurality of rows based on a plurality of clock signals inputted from an external source, the light-emission enable signals sequentially going to an on level, and a unit circuit forming each of the stages of the shift register includes:

a first node;

a first output node configured to output an other-stage control signal that controls operation of a unit circuit of a different stage;

a second output node configured to output the light-emission enable signal;

a first transistor having: a control terminal to which the other-stage control signal outputted from a unit circuit of a previous stage is provided; a first conduction terminal to which the other-stage control signal is provided; and a second conduction terminal connected to the first node;

a second transistor having: a control terminal connected to the first node; a first conduction terminal to which one of the plurality of clock signals is provided; and a second conduction terminal connected to the first output node;

a third transistor having: a control terminal connected to the first node; a first conduction terminal to which an on-level direct-current power supply voltage is provided; and a second conduction terminal connected to the second output node;

a fourth transistor having: a control terminal to which the other-stage control signal outputted from a unit circuit of a subsequent stage is provided; a first conduction terminal connected to the first output node; and a second conduction terminal to which an off-level direct-current power supply voltage is provided;

a fifth transistor having: a control terminal to which the other-stage control signal outputted from the unit circuit of the subsequent stage is provided; a first conduction terminal connected to the first node; and a second conduction terminal to which an off-level direct-current power supply voltage is provided; and a sixth transistor having: a control terminal to which a subframe reset signal is provided, the subframe reset signal going to anon level at an end time point of each subframe; a first conduction terminal connected to the second output node; and a second conduction terminal to which an off-level direct-current power supply voltage is provided.

According to a sixth aspect of the present invention, in the first aspect of the present invention, when j pixel circuits are defined as one group, and j pixel circuits included in each group and j light-emission control lines corresponding to the j pixel circuits are focused, each of the focused j light-emission control lines is connected to light-emission control transistors corresponding to electro-optical elements that are configured to emit light of different colors in the focused j pixel circuits.

According to a seventh aspect of the present invention, in the first aspect of the present invention, the light-emission enable signal switching unit includes:

a second control signal generating unit configured to generate a second control signal; and a demultiplexer having at least j outputs corresponding to the j light-emission control lines, respectively, the demultiplexer switches output of the light-emission enable signal provided as an input signal, based on the second control signal, and the second control signal generating unit generates the second control signal such that the demultiplexer outputs the light-emission enable signal from different outputs in different subframes, and the demultiplexer outputs the light-emission enable signal once from each of the j outputs during one frame period.

According to an eighth aspect of the present invention, in the seventh aspect of the present invention, a black display period during which the j electro-optical elements included in each of the pixel circuits are brought into a light-off state and image data corresponding to a black color is written to the pixel circuits is provided between two consecutive subframes, and the demultiplexer is formed using a CMOS circuit.

According to a ninth aspect of the present invention, in the seventh aspect of the present invention, the demultiplexer is provided for each row, in each row, the j outputs of the demultiplexer are connected to their corresponding light-emission control lines.

According to a tenth aspect of the present invention, in the seventh aspect of the present invention, only one demultiplexer is provided, and the j outputs of the demultiplexer are connected, in all the rows, to their corresponding light-emission control lines.

According to an eleventh aspect of the present invention, in the first aspect of the present invention, the active matrix-type display device further comprises:

scanning signal lines provided for the respective rows;

data lines provided for the respective columns;

a first power supply line configured to supply a high-level direct-current power supply voltage to the pixel circuits; and a second power supply line configured to supply a low-level direct-current power supply voltage to the pixel circuits, wherein the drive current control unit includes:

a drive transistor configured to control the drive current, the drive transistor being provided between the first power supply line and the second power supply line and in series with each of the j light-emission control transistors;

an input transistor configured to electrically connect a control terminal of the drive transistor to a corresponding data line when a corresponding scanning signal line is brought into a selected state, the input transistor being provided between the control terminal of the drive transistor and the corresponding data line; and a capacitor provided between the control terminal of the drive transistor and one conduction terminal of the drive transistor.

According to a twelfth aspect of the present invention, in the first aspect of the present invention, a black display period during which the j electro-optical elements included in each of the pixel circuits are brought into a light-off state and image data corresponding to a black color is written to the pixel circuits is provided between two consecutive subframes.

A thirteenth aspect of the present invention is directed to a method for driving an active matrix-type display device that performs color image display by dividing one frame period into j subframes (j is an integer greater than or equal to 3) and displaying different color screens in different subframes, the active matrix-type display device including: pixel circuits arranged in a matrix form so as to form a plurality of rows and a plurality of columns, each of the pixel circuits including: j electro-optical elements configured to emit light of different colors respectively; a drive current control unit configured to control a drive current for bringing the j electro-optical elements into a light-emitting state; and j light-emission control transistors configured to control supply of the drive current to their corresponding electro-optical elements, the j light-emission control transistors being provided in a one-to-one correspondence with the j electro-optical elements; and j light-emission control lines provided for each row in a one-to-one correspondence with the j light-emission control transistors in the pixel circuit, the method comprising:

a light-emission enable signal generating step of generating a light-emission enable signal for controlling on/off states of the j light-emission control transistors, the light-emission enable signal being a signal to be supplied to the j light-emission control lines; and a light-emission enable signal switching step of switching a supply destination of the light-emission enable signal among the j light-emission control lines in each row, such that the light-emission enable signal is supplied to different light-emission control lines indifferent subframes, the light-emission enable signal being generated in the light-emission enable signal generating step.

Effects of the Invention

According to the first aspect of the present invention, in a display device configured to be provided with a light-emission enable signal generating unit that generates a light-emission enable signal for controlling the on/off states of j light-emission control transistors which are provided in a one-to-one correspondence with j electro-optical elements (j is an integer greater than or equal to 3) in a pixel circuit; and j light-emission control lines for supplying the light-emission enable signal to each of the j light-emission control transistors, the light-emission enable signal generated by the light-emission enable signal generating unit is supplied to different light-emission control lines in different subframes by a light-emission enable signal switching unit. Since such a light-emission enable signal switching unit is provided, it is only necessary to generate one light-emission enable signal for each row. Therefore, the number of components (typically, drivers) for generating a light-emission enable signal can be reduced over conventional devices. By this, picture-frame size can be reduced over conventional devices, achieving miniaturization of a display device.

According to the second aspect of the present invention, as components for controlling the on/off states of j light-emission control transistors included in each pixel circuit, there are required a light-emission enable signal generating unit for only one system and j light-emission enable signal supply control transistors for each row. On the other hand, according to the conventional art, there are required light-emission enable signal generating units for j systems. The light-emission enable signal generating unit includes at least six transistors, and thus, according to the second aspect of the present invention, the transistor occupied area is reduced over conventional devices. Therefore, picture-frame size can be reduced over conventional devices, achieving miniaturization of a display device.

According to the third aspect of the present invention, thin-film transistors each having a channel layer formed of an oxide semiconductor are used. Hence, miniaturization of transistors is possible, enabling to more easily miniaturize a display device.

According to the fourth aspect of the present invention, by using indium gallium zinc oxide as the oxide semiconductor forming the channel layer, the effect of the third aspect of the present invention can be securely attained.

According to the fifth aspect of the present invention, in a display device configured such that the light-emission enable signal generating unit includes a shift register having a plurality of stages (unit circuits) each including six transistors, picture-frame size can be reduced over conventional devices.

According to the sixth aspect of the present invention, in each subframe, in j pixel circuits included in each group, electro-optical elements with different light-emitting colors go into a light-emitting state. That is, in each subframe, there are mixed light-emitting colors. By this, the occurrence of color breakup which is likely to occur when time-division driving (field sequential driving) is adopted is suppressed. By the above, a display device is implemented, in which picture-frame size is reduced over conventional devices while the occurrence of color breakup is suppressed.

According to the seventh aspect of the present invention, as components for controlling the on/off states of j light-emission control transistors included in each pixel circuit, there are required a light-emission enable signal generating unit for only one system and a demultiplexer. On the other hand, according to the conventional art, there are required light-emission enable signal generating units for j systems. Therefore, according to the seventh aspect of the present invention, the circuit occupied area by the light-emission enable signal generating unit can be reduced over conventional devices.

According to the eighth aspect of the present invention, before starting each subframe, writing of data corresponding to black display (black insertion) is performed. Here, the demultiplexer is formed using a CMOS circuit. Hence, black insertion can be performed at high speed, improving display quality for moving image display.

According to the ninth aspect of the present invention, in a display device configured such that a demultiplexer is provided for each row, the same effect as that of the seventh aspect of the present invention can be obtained.

According to the tenth aspect of the present invention, the on/off states of all the light-emission control transistors can be controlled by only one demultiplexer. By this, picture-frame size can be significantly reduced over conventional devices.

According to the eleventh aspect of the present invention, in a display device configured such that a drive current control unit that controls a drive current for bringing the electro-optical elements into a light-emitting state includes a drive transistor, an input transistor, and a capacitor, the same effect as that of the first aspect of the present invention can be obtained.

According to the twelfth aspect of the present invention, before starting each subframe, writing of data corresponding to black display is performed. Hence, the electro-optical elements are prevented from emitting light at luminance determined according to the last writing.

According to the thirteenth aspect of the present invention, the same effect as that of the first aspect of the present invention can be provided in a method for driving a display device.

MODES FOR CARRYING OUT THE INVENTION

Embodiments of the present invention will be described below with reference to the accompanying drawings. Note that in the following it is assumed that m and n are integers greater than or equal to 2. Note also that, for each transistor, the gate terminal corresponds to a control terminal, the drain terminal corresponds to a first conduction terminal, and the source terminal corresponds to a second conduction terminal.

1. First Embodiment

1.1 Overall Configuration and Summary of Operation

Figure 2:
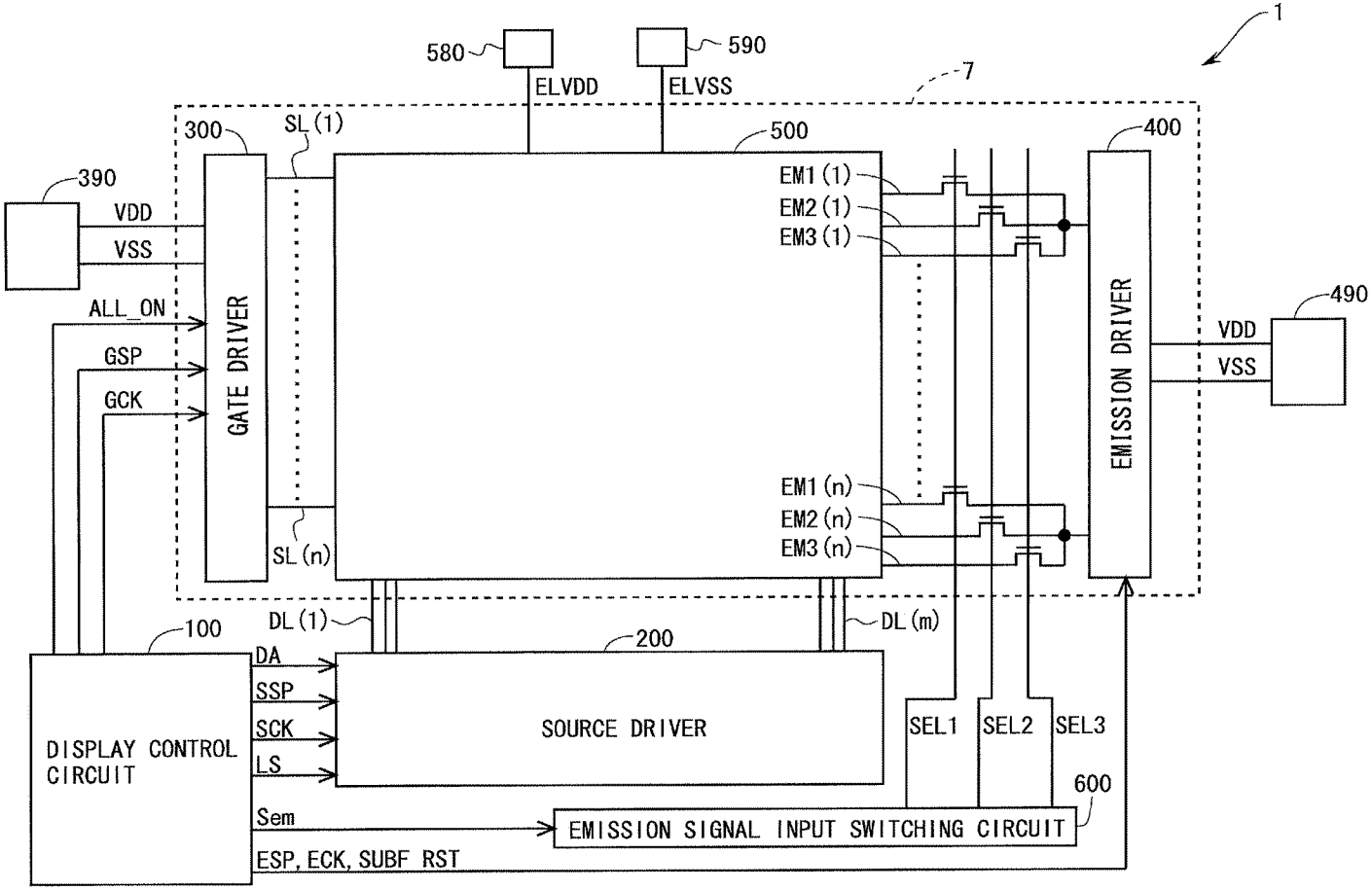
FIG. 2 is a block diagram showing an overall configuration of the organic EL display device in the first embodiment.

FIG. 2 is a block diagram showing an overall configuration of an active matrix-type organic EL display device 1 according to a first embodiment of the present invention. The organic EL display device 1 includes a display control circuit 100, a source driver (data line drive circuit) 200, a gate driver (scanning signal line drive circuit) 300, an emission driver 400, a display unit 500, and an emission signal input switching circuit 600. Note that the gate driver 300 and the emission driver 400 are formed in an organic EL panel 7 including the display unit 500 in the present embodiment. That is, the gate driver 300 and the emission driver 400 are monolithic. In addition, the organic EL display device 1 is provided with a logic power supply 390, a logic power supply 490, an organic EL high-level power supply 580, and an organic EL low-level power supply 590, as components for supplying various types of power supply voltages to the organic EL panel 7.

A high-level power supply voltage VDD and a low-level power supply voltage VSS which are required for the operation of the gate driver 300 are supplied to the organic EL panel 7 from the logic power supply 390. A high-level power supply voltage VDD and a low-level power supply voltage VSS which are required for the operation of the emission driver 400 are supplied to the organic EL panel 7 from the logic power supply 490. A high-level power supply voltage ELVDD which is a constant voltage is supplied to the organic EL panel 7 from the organic EL high-level power supply 580. A low-level power supply voltage ELVSS which is a constant voltage is supplied to the organic EL panel 7 from the organic EL low-level power supply 590.

Figure 3:
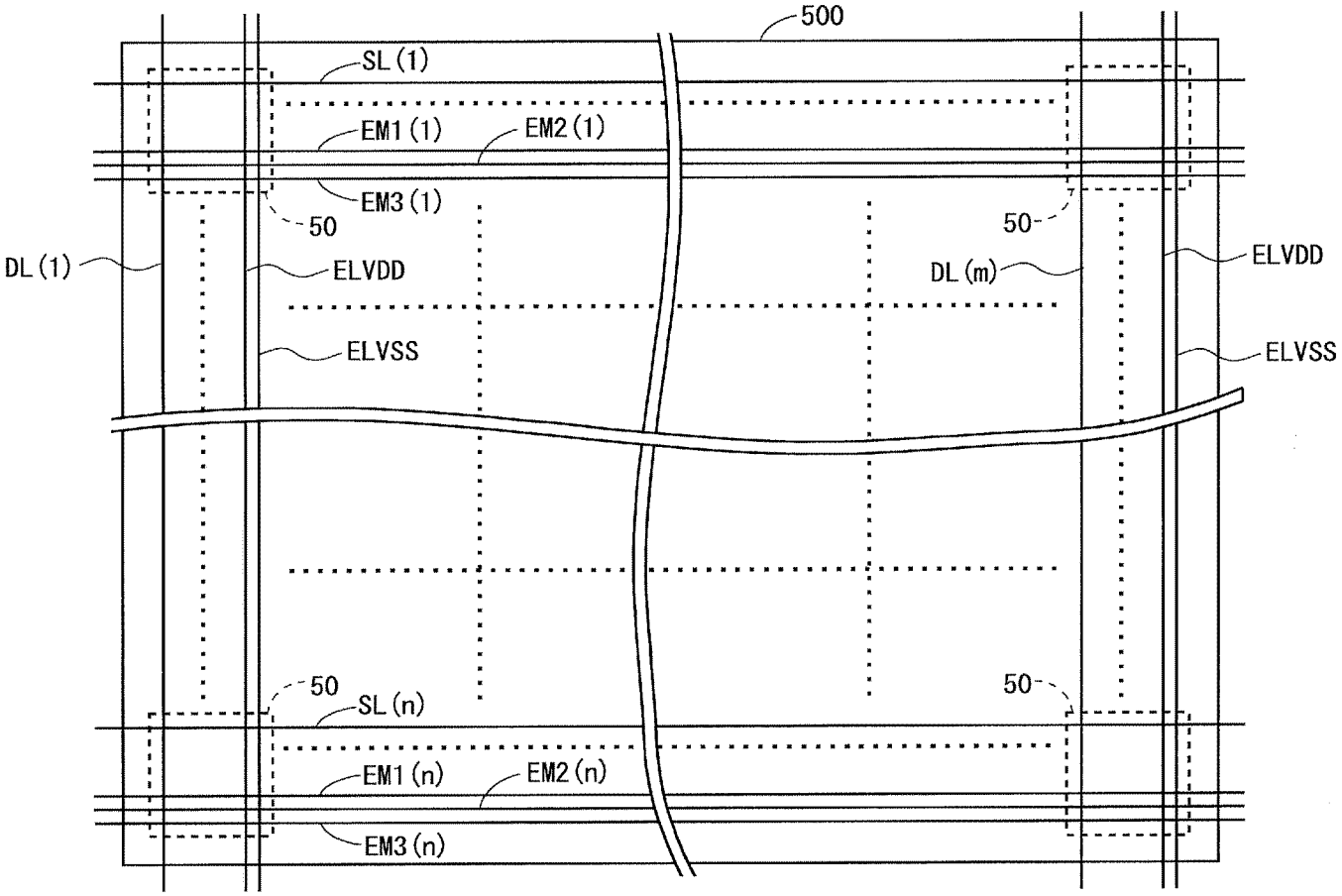
FIG. 3 is a diagram for describing a configuration of a display unit in the first embodiment.

FIG. 3 is a diagram for describing a configuration of the display unit 500 in the present embodiment. In the display unit 500, as shown in FIG. 3, m data lines DL(1) to DL(m) and n scanning signal lines SL(1) to SL(n) are disposed so as to intersect each other. Pixel circuits 50 are provided at the respective intersections of the data lines DL(1) to DL(m) and the scanning signal lines SL(1) to SL(n). That is, in the display unit 500, the pixel circuits 50 are arranged in a matrix form so as to form a plurality of rows (n rows) and a plurality of columns (m columns). In addition, in the display unit 500, n first emission lines EM1(1) to EM1(*n*), n second emission lines EM2(1) to EM2(*n*), and n third emission lines EM3(1) to EM3(*n*) are disposed for the respective n scanning signal lines SL(1) to SL(n). Furthermore, in the display unit 500, high-level power supply lines ELVDD and low-level power supply lines ELVSS are disposed. In the present embodiment, a first power supply line is implemented by the high-level power supply lines ELVDD, and a second power supply line is implemented by the low-level power supply lines ELVSS. A detailed configuration of the pixel circuits 50 will be described later.

Note that in the following, when the m data lines DL(1) to DL(m) do not need to be distinguished from each other, the data lines are simply represented by reference character DL. Likewise, the scanning signal lines, the first emission lines, the second emission lines, and the third emission lines are simply represented by reference characters SL, EM1, EM2, and EM3, respectively. In addition, the first to third emission lines EM1 to EM3 are also collectively and simply referred to as "emission lines". The emission lines are denoted by reference character EM. In the present embodiment, light-emission control lines are implemented by the emission lines EM.

The display control circuit 100 outputs display data DA; a source start pulse signal SSP, a source clock signal SCK, and a latch strobe signal LS which are for controlling the operation of the source driver 200; a gate start pulse signal GSP, a gate clock signal GCK, and an all-on signal ALL_ON which are for controlling the operation of the gate driver 300; an emission start pulse signal ESP, an emission clock signal ECK, and a subframe reset signal SUBF_RST which are for controlling the operation of the emission driver 400; and an emission switching instruction signal Sem which is for controlling the operation of the emission signal input switching circuit 600.

The source driver 200 receives the display data DA, the source start pulse signal SSP, the source clock signal SCK, and the latch strobe signal LS which are transmitted from the display control circuit 100, and applies driving video signals to the data lines DL(1) to DL(m).

Figure 4:
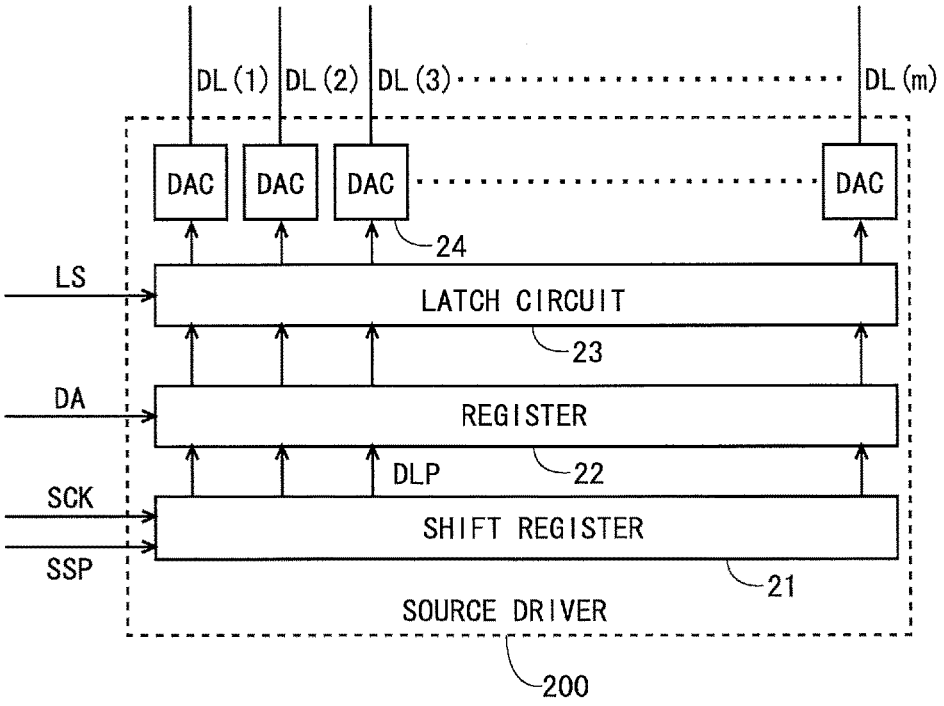
FIG. 4 is a block diagram showing an exemplary configuration of a source driver in the first embodiment.

FIG. 4 is a block diagram showing an exemplary configuration of the source driver 200. The source driver 200 includes an m-bit shift register 21, a register 22, a latch circuit 23, and m D/A converters (DAC) 24. The shift register 21 has m cascade-connected registers (not shown). The shift register 21 sequentially transfers a pulse of the source start pulse signal SSP to be supplied to a first-stage register, from an input terminal to an output terminal, based on the source clock signal SCK. According to the pulse transfer, timing pulses DLP for the respective data lines DL are outputted from the shift register 21. Based on the timing pulses DLP, the register 22 stores the display data DA. The latch circuit 23 captures and holds the display data DA for one row which is stored in the register 22, according to the latch strobe signal LS. The D/A converters 24 are provided for the respective data lines DL. The D/A converters 24 convert the display data DA held in the latch circuit 23 into analog voltages. The converted analog voltages are applied as driving video signals to all the data lines DL(1) to DL(m) at the same time.

The gate driver 300 sequentially applies an active scanning signal to the n scanning signal lines SL(1) to SL(n), based on the gate start pulse signal GSP and the gate clock signal GCK which are transmitted from the display control circuit 100. The gate driver 300 also applies active scanning signals to the n scanning signal lines SL(1) to SL(n) at the same time, based on the all-on signal ALL_ON which is transmitted from the display control circuit 100. Note that, as for the scanning signal line SL, the state in which an active scanning signal is being applied to is referred to as "selected state". The same also applies to the emission lines EM. When a scanning signal line SL is in a selected state, writing of data is performed in the pixel circuits 50 provided for the scanning signal line SL. Note that in this specification the writing of data corresponding to black display to the pixel circuits, separately from original video data, is referred to as "black insertion".

Figure 5:
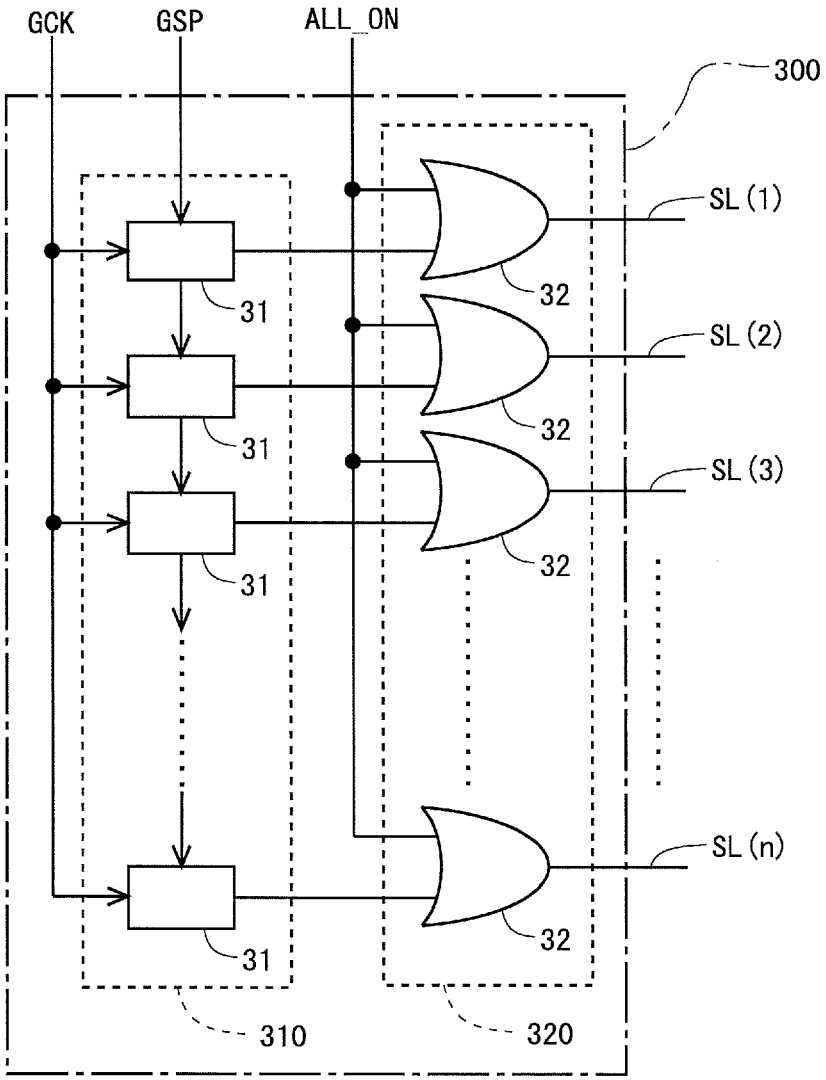
FIG. 5 is a block diagram showing an exemplary configuration of a gate driver in the first embodiment.

FIG. 5 is a block diagram showing an exemplary configuration of the gate driver 300 in the present embodiment. The gate driver 300 is composed of a shift register 310 including n flip-flop circuits 31; and a black insertion control unit 320 for performing control of black insertion. The shift register 310 is configured such that the gate start pulse signal GSP is provided to a first-stage flip-flop circuit 31, and the gate clock signal GCK is provided to all the flip-flop circuits 31 in a shared manner. The black insertion control unit 320 is provided with n OR circuits 32 such that the OR circuits 32 have a one-to-one correspondence with the flip-flop circuits 31 in the shift register 310. To the OR circuits 32 are inputted output signals from their corresponding flip-flop circuits 31 and the all-on signal ALL_ON. In addition, output signals from the OR circuits 32 are provided as scanning signals to the scanning signal lines SL.

Figure 6:
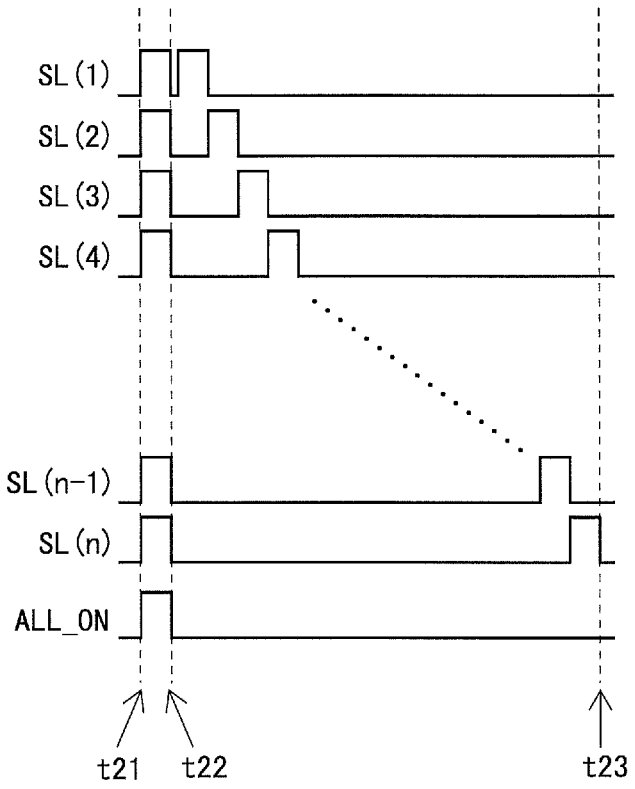
FIG. 6 is a timing chart for describing the operation of the gate driver in the first embodiment.

In a configuration such as that described above, when the all-on signal ALL_ON is at a high level, a high-level signal is provided to all the OR circuits 32. By this, as shown in the period of time point t21 to time point t22 in FIG. 6, the n scanning signal lines SL(1) to SL(n) go into a selected state at the same time. When a pulse of the gate start pulse signal GSP is provided to the first-stage flip-flop circuit 31 of the shift register 310 with the all-on signal ALL_ON being at a low level, a pulse included in the gate start pulse signal GSP is sequentially transferred from the first-stage flip-flop circuit 31 to an nth-stage flip-flop circuit 31, based on the gate clock signal GCK. Then, according to the pulse transfer, output signals from the first- to nth-stage flip-flop circuits 31 sequentially go to a high level. By this, as shown in the period of time point t22 to time point t23 in FIG. 6, the n scanning signal lines SL(1) to SL(n) sequentially go into a selected state for a predetermined period.

The emission driver 400 outputs light-emission enable signals to be supplied to the emission lines EM, based on the emission start pulse signal ESP, the emission clock signal ECK, and the subframe reset signal SUBF_RST which are transmitted from the display control circuit 100. A detailed description of the emission driver 400 will be made later. Note that in the present embodiment a light-emission enable signal generating unit is implemented by the emission driver 400.

The emission signal input switching circuit 600 outputs selection signals SEL1, SEL2, and SEL3, based on the emission switching instruction signal Sem which is transmitted from the display control circuit 100. In the present embodiment, one of the three selection signals SEL1, SEL2, and SEL3 is brought to "active" ("high level" in the present embodiment) every subframe, based on the emission switching instruction signal Sem. Note that in the present embodiment a first control signal generating unit is implemented by the emission signal input switching circuit 600, and a first control signal is implemented by the selection signals SEL1, SEL2, and SEL3.

1.2 Configuration of the Pixel Circuits

Figure 7:
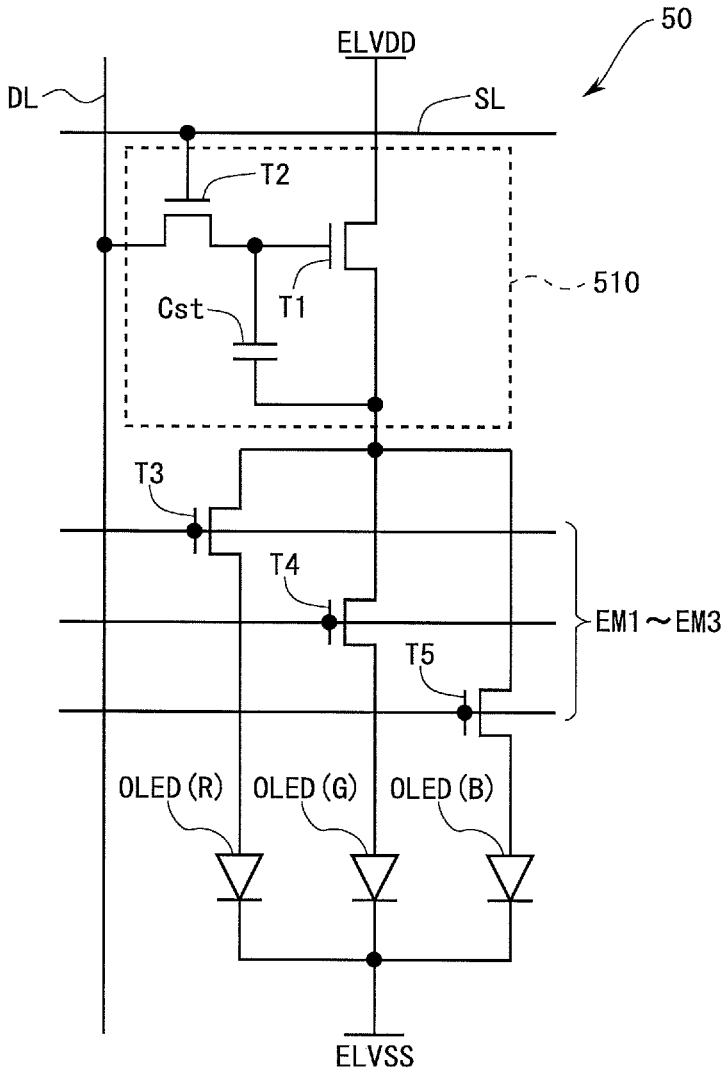
FIG. 7 is a circuit diagram showing a configuration of a pixel circuit of the first embodiment.

FIG. 7 is a circuit diagram showing a configuration of a pixel circuit 50 in the present embodiment. The pixel circuit 50 is provided at an intersection of a corresponding one of the m data lines DL(1) to DL(m) and a corresponding one of the n scanning signal lines SL(1) to SL(n) which are disposed in the display unit 500. As shown in FIG. 7, the pixel circuit 50 includes five transistors T1 to T5, one capacitor Cst, and three organic EL elements OLED(R), OLED(G), and OLED(B). The transistor T1 is a drive transistor and the transistor T2 is an input transistor. The transistors T3, T4, and T5 function as light-emission control transistors that perform light emission control by controlling the supply of a drive current to the organic EL elements OLED(R), OLED(G), and OLED(B). The organic EL element OLED(R) functions as an electro-optical element that emits red light. The organic EL element OLED(G) functions as an electro-optical element that emits green light. The organic EL element OLED(B) functions as an electro-optical element that emits blue light. In the following, the three organic EL elements OLED(R), OLED(G), and OLED(B) are also collectively and simply referred to as "organic EL elements OLED".

Note that in the present embodiment a drive current control unit 510 that controls a drive current for bringing the organic EL elements OLED into a light-emitting state is implemented by the transistor T1, the transistor T2, and the capacitor Cst.

As shown in FIG. 7, the transistor T1 is provided in series with each of the transistors T3 to T5 and in series with each of the organic EL elements OLED(R), OLED(G), and OLED(B). In other words, the transistor T1 and the organic EL element OLED(R) are connected in series with each other through the transistor T3, the transistor T1 and the organic EL element OLED(G) are connected in series with each other through the transistor T4, and the transistor T1 and the organic EL element OLED(B) are connected in series with each other through the transistor T5. The transistor T1 is connected at its gate terminal to a drain terminal of the transistor T2, connected at its drain terminal to a high-level power supply line ELVDD, and connected at its source terminal to drain terminals of the transistors T3 to T5. The transistor T2 is provided between the data line DL and the gate terminal of the transistor T1. The transistor T2 is connected at its gate terminal to the scanning signal line SL, connected at its drain terminal to the gate terminal of the transistor T1, and connected at its source terminal to the data line DL. The capacitor Cst is connected at its one end to the gate terminal of the transistor T1 and connected at its other end to the source terminal of the transistor T1. The transistor T3 is connected at its drain terminal to the source terminal of the transistor T1 and connected at its source terminal to an anode terminal of the organic EL element OLED(R). The transistor T4 is connected at its drain terminal to the source terminal of the transistor T1 and connected at its source terminal to an anode terminal of the organic EL element OLED(G). The transistor T5 is connected at its drain terminal to the source terminal of the transistor T1 and connected at its source terminal to an anode terminal of the organic EL element OLED(B). Gate terminals of the transistors T3 to T5 are connected to the first to third emission lines EM1 to EM3, respectively. Cathode terminals of the organic EL elements OLED(R), OLED(G), and OLED(B) are connected to an organic EL low-level power supply line ELVSS.

Meanwhile, in the present embodiment, all the transistors T1 to T5 in the pixel circuit 50 are of an n-channel type. In addition, in the present embodiment, for the transistors T1 to T5, oxide TFTs (thin-film transistors using an oxide semiconductor for a channel layer) are adopted. The same also applies to transistors Tem1 to Tem3 which will be described later.

An oxide semiconductor layer included in an oxide TFT will be described below. The oxide semiconductor layer is, for example, an In—Ga—Zn—O-based semiconductor layer. The oxide semiconductor layer includes, for example, an In—Ga—Zn—O-based semiconductor. The In—Ga—Zn—O-based semiconductor is a ternary oxide of In (indium), Ga (gallium), and Zn (zinc). The ratio (composition ratio) of In, Ga, and Zn is not particularly limited. For example, the ratio may be such that In:Ga:Zn=2:2:1, In:Ga:Zn=1:1:1, or In:Ga:Zn=1:1:2.

A TFT having an In—Ga—Zn—O-based semiconductor layer has high mobility (mobility exceeding 20 times that of an amorphous silicon TFT) and low leakage current (leakage current less than 1/100 of that of an amorphous silicon TFT), and thus is suitably used as a drive TFT (the above-described transistor T1) and a switching TFT (the above-described transistor T2) in the pixel circuit 50. When a TFT having an In—Ga—Zn—O-based semiconductor layer is used, the power consumption of a display device can be significantly reduced.

The In—Ga—Zn—O-based semiconductor may be amorphous, or may include a crystalline portion and have crystallinity. For the crystalline In—Ga—Zn—O-based semiconductor, a crystalline In—Ga—Zn—O-based semiconductor where the c-axis is aligned roughly perpendicular to a layer surface is preferably used. A crystal structure of such an In—Ga—Zn—O-based semiconductor is disclosed in, for example, Japanese Patent Application Laid-Open No. 2012-134475.

The oxide semiconductor layer may include other oxide semiconductors instead of an In—Ga—Zn—O-based semiconductor. The oxide semiconductor layer may include, for example, an Zn—O-based semiconductor (ZnO), an In—Zn—O-based semiconductor (IZO (registered trademark)), a Zn—Ti—O-based semiconductor (ZTO), a Cd—Ge—O-based semiconductor, a Cd—Pb—O-based semiconductor, CdO (cadmium oxide), a Mg—Zn—O-based semiconductor, an In—Sn—Zn—O-based semiconductor (e.g., $In_2O_3$—$SnO_2$—ZnO), or an In—Ga—Sn—O-based semiconductor.

1.3 Configuration of a Main Part (Configuration of a Portion Between a Pixel Circuit and the Emission Driver)

Figure 1:
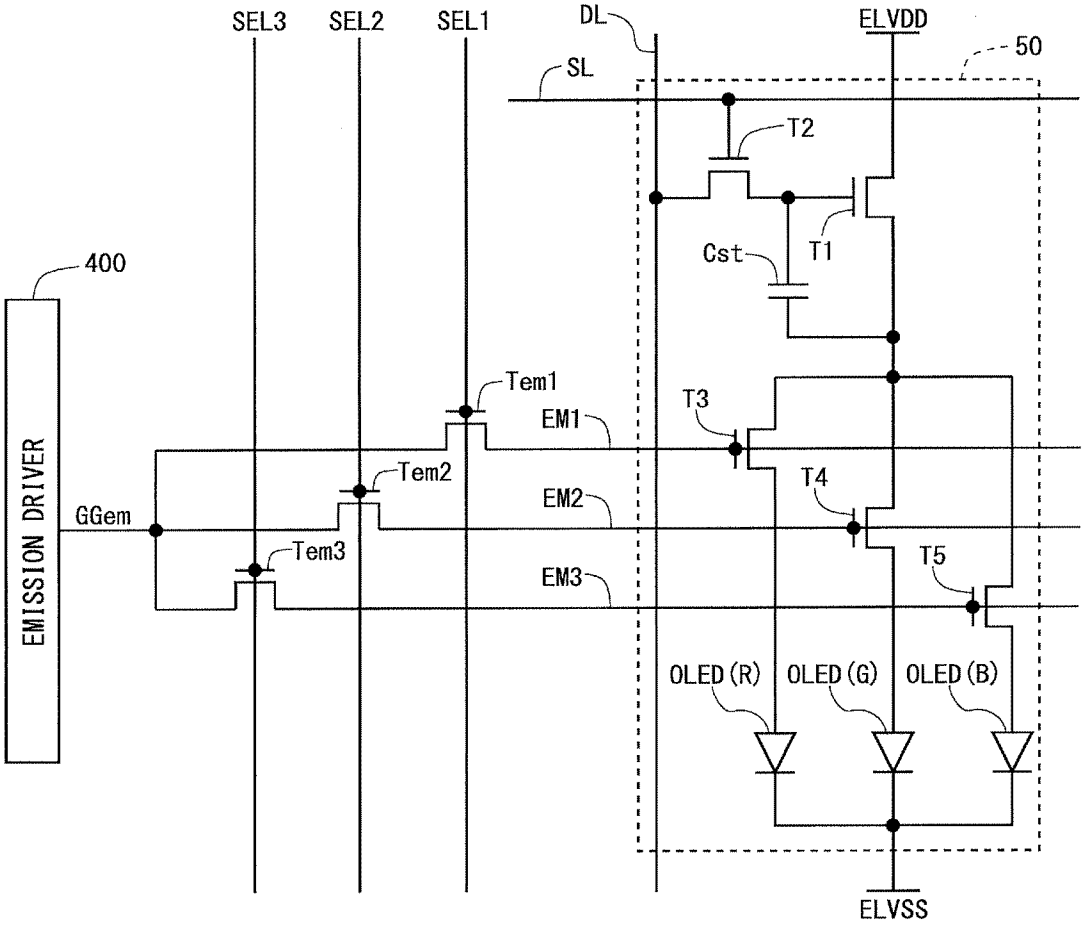
FIG. 1 is a circuit diagram showing a configuration of a main part of an active matrix-type organic EL display device (a configuration of a portion between a pixel circuit and an emission driver) according to a first embodiment of the present invention.

FIG. 1 is a circuit diagram showing a configuration of a main part (a configuration of a portion between a pixel circuit 50 and the emission driver 400) in the present embodiment. As can be grasped from FIGS. 1 and 2, in the present embodiment, three emission lines EM (a first emission line EM1, a second emission line EM2, and a third emission line EM3) are provided for each row. As shown in FIG. 1, transistors Tem1 to Tem3 whose on/off states are controlled by selection signals SEL1 to SEL3, respectively, are provided between the emission driver 400 and the first to third emission lines EM1 to EM3. Light-emission enable signal supply control transistors are implemented by the transistors Tem1 to Tem3. The transistor Tem1 has a gate terminal to which the selection signal SEL1 is provided, a drain terminal connected to the emission driver 400, and a source terminal connected to the first emission line EM1. The transistor Tem2 has a gate terminal to which the selection signal SEL2 is provided, a drain terminal connected to the emission driver 400, and a source terminal connected to the second emission line EM2. The transistor Tem3 has a gate terminal to which the selection signal SEL3 is provided, a drain terminal connected to the emission driver 400, and a source terminal connected to the third emission line EM3.

In a configuration such as that described above, the emission signal input switching circuit 600 brings one of the three selection signals SEL1, SEL2, and SEL3 to a high level every subframe. When the selection signal SEL1 is at a high level, the transistor Tem1 goes into an on state, and a light-emission enable signal GGem outputted from the emission driver 400 is supplied to the first emission line EM1. When the selection signal SEL2 is at a high level, the transistor Tem2 goes into an on state, and the light-emission enable signal GGem outputted from the emission driver 400 is supplied to the second emission line EM2. When the selection signal SEL3 is at a high level, the transistor Tem3 goes into an on state, and the light-emission enable signal GGem outputted from the emission driver 400 is supplied to the third emission line EM3.

Figure 8:
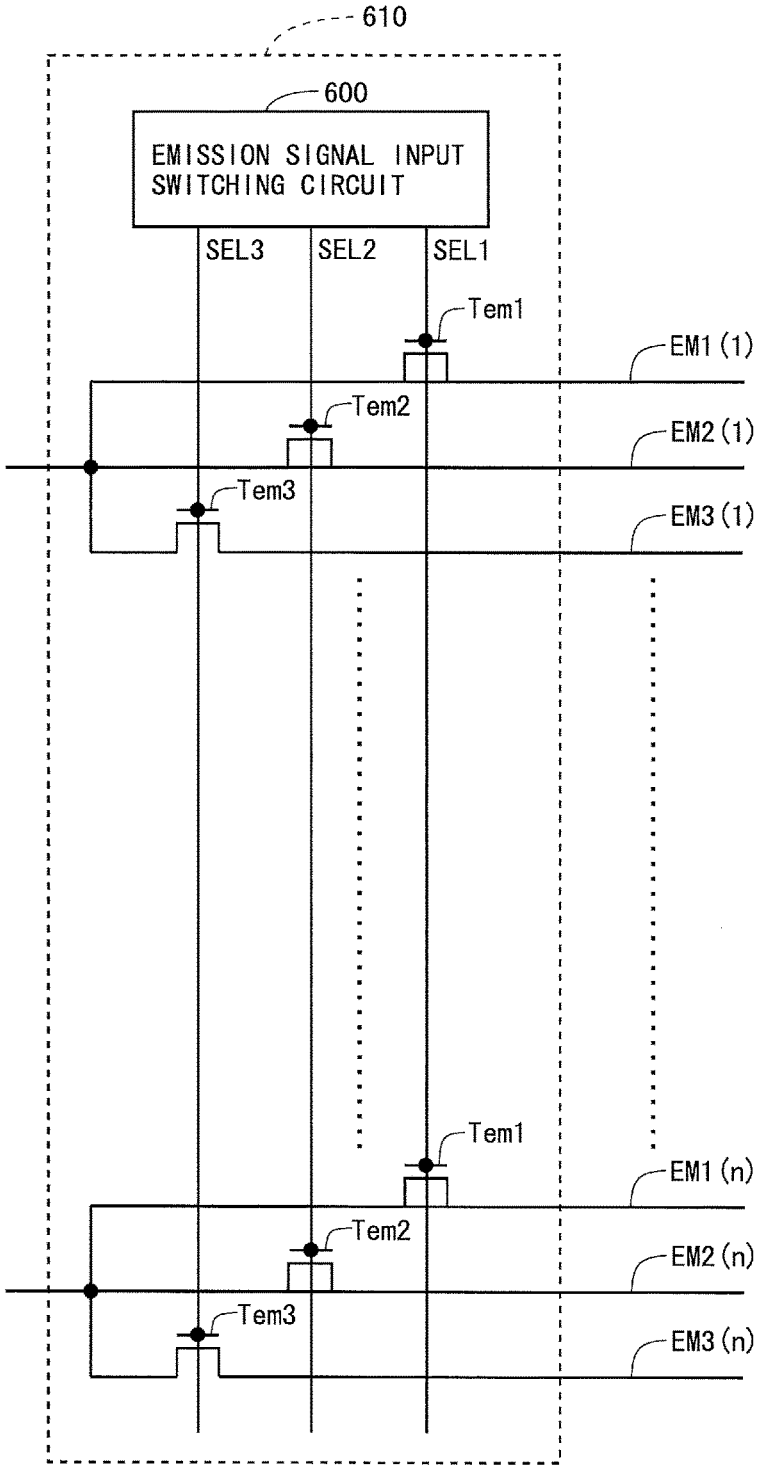
FIG. 8 is a diagram showing a configuration of a light-emission enable signal switching unit in the first embodiment.

In the above-described manner, the light-emission enable signal GGem outputted from one emission driver 400 is sequentially supplied to the three emission lines EM (the first emission line EM1, the second emission line EM2, and the third emission line EM3) for each subframe. As described above, in the present embodiment, a light-emission enable signal switching unit 610 is implemented by the emission signal input switching circuit 600 and the transistors Tem1 to Tem3 provided for each row (see FIG. 8).

Figure 9:
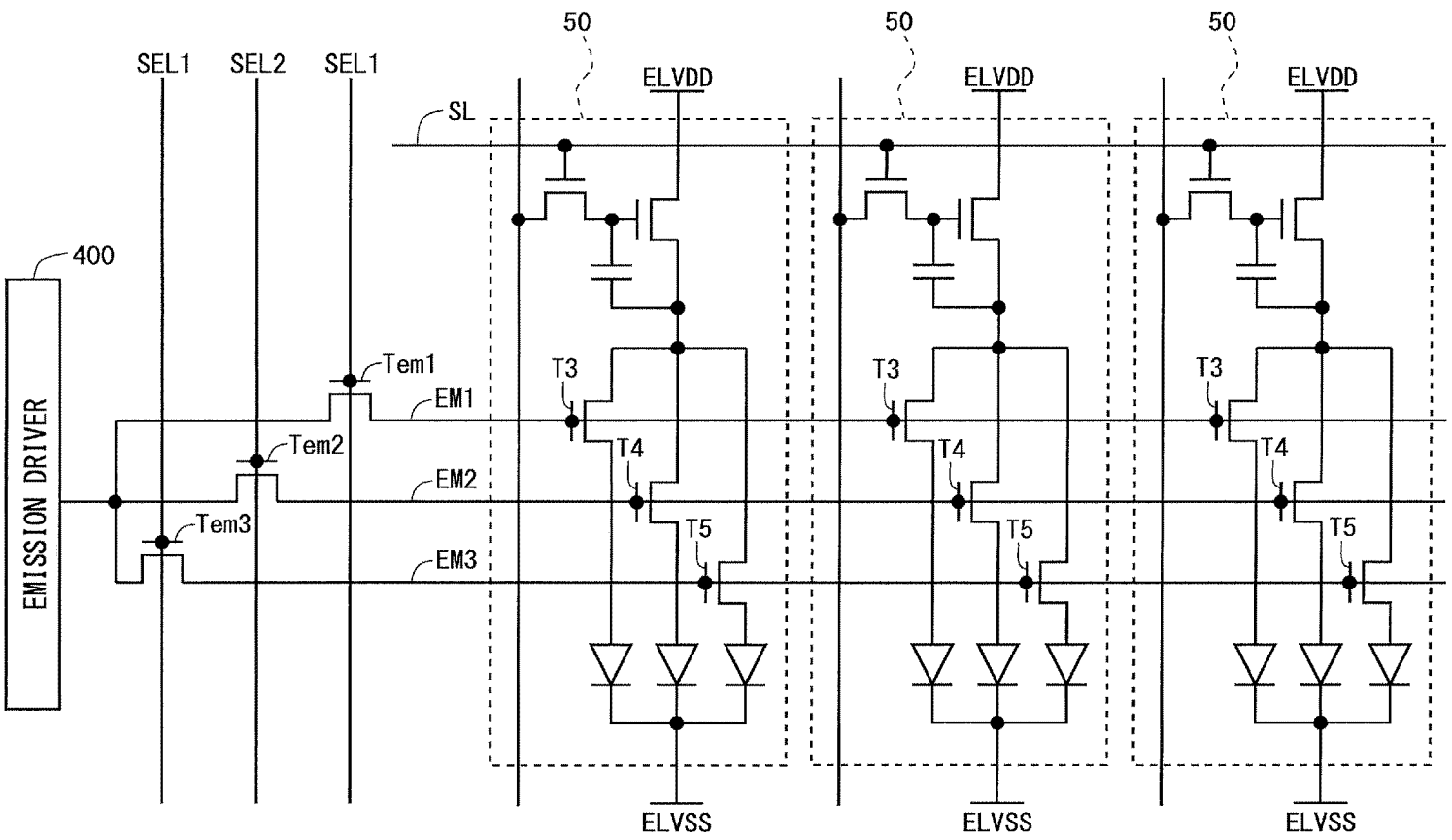
FIG. 9 is a diagram for describing a connection relationship between first to third emission lines and transistors T3 to T5 in the first embodiment.

Note that in the present embodiment, unlike a second embodiment which will be described later, as shown in FIG. 9, in the pixel circuits 50 of all columns, the first emission line EM1 is connected to the gate terminals of the transistors T3, the second emission line EM2 is connected to the gate terminals of the transistors T4, and the third emission line EM3 is connected to the gate terminals of the transistors T5.

1.4 Emission Driver

<1.4.1 Schematic Configuration>

Figure 10:
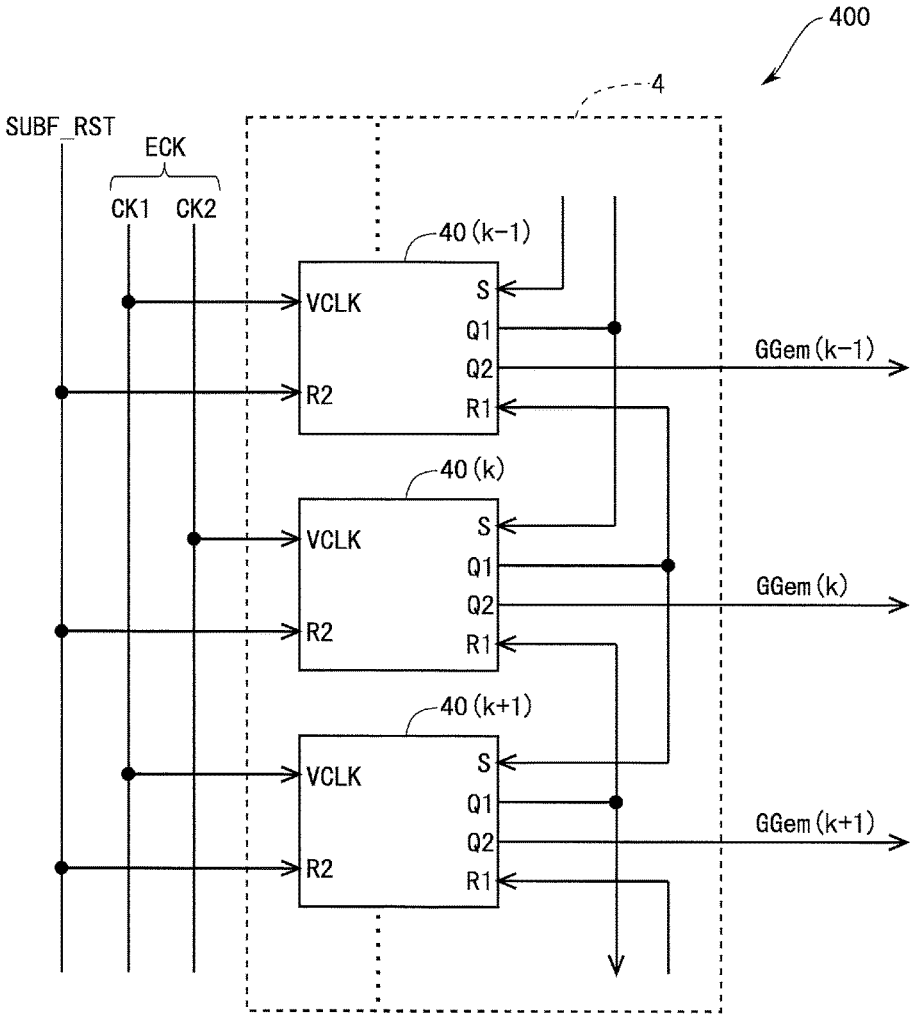
FIG. 10 is a block diagram showing an exemplary configuration of the emission driver in the first embodiment.

FIG. 10 is a block diagram showing an exemplary configuration of the emission driver 400 in the present embodiment. The emission driver 400 is composed of a shift register 4 of n stages including n unit circuits 40. Note that FIG. 10 Shows unit circuits 40 ($k$−1) to 40 ($k$+1) of a (k−1)th stage to a (k+1)th stage. Here, k is an even number between 2 and (n−2), inclusive. Each unit circuit 40 is provided with an input terminal for receiving a clock signal VCLK, an input terminal for receiving a set signal S, an input terminal for receiving a first reset signal R1, an input terminal for receiving a second reset signal R2, an output terminal for outputting a first output signal Q1, and an output terminal for outputting a second output signal Q2. Note that although each unit circuit 40 further includes an input terminal for receiving a high-level power supply voltage VDD and input terminals for receiving a low-level power supply voltage VSS, depiction thereof is omitted in FIG. 10.

Figure 11:
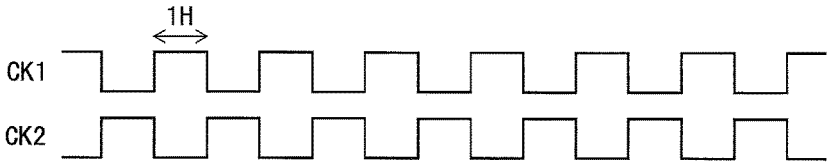
FIG. 11 is a waveform diagram of emission clock signals provided to the emission driver in the first embodiment.

Two-phase clock signals (a first clock signal CK1 and a second clock signal CK2) such as those shown in FIG. 11 are provided as an emission clock signal ECK to the shift register 4 composing the emission driver 400. The first clock signal CK1 and the second clock signal CK2 are shifted in phase by one horizontal scanning period from each other. In addition, both the first clock signal CK1 and the second clock signal CK2 go into a high-level state for one horizontal scanning period during two horizontal scanning periods.

Signals to be provided to the input terminals of each stage (each unit circuit) of the shift register 4 are as follows. For the odd-numbered stages, the first clock signal CK1 is provided as a clock signal VCLK. For the even-numbered stages, the second clock signal CK2 is provided as a clock signal VCLK. In addition, for any stage, a first output signal Q1 outputted from the previous stage is provided as a set signal S, and a first output signal Q1 outputted from the subsequent stage is provided as a first reset signal R1. Note, however, that for the first stage, an emission start pulse signal ESP is provided as a set signal S. Furthermore, a subframe reset signal SUBF_RST is provided as a second reset signal R2 to all stages in a shared manner.

In a configuration such as that described above, when a pulse of the emission start pulse signal ESP serving as a set signal S is provided to the first stage of the shift register 4, a shift pulse included in the first output signal Q1 which is outputted from each stage is sequentially transferred from the first stage to the nth stage, based on the first clock signal CK1 and the second clock signal CK2. Then, according to the shift pulse transfer, the first output signals Q1 outputted from the respective stages sequentially go to a high level, and second output signals Q2 outputted from the respective stages sequentially go to a high level. Note that the second output signals Q2 outputted from the respective stages are provided as light-emission enable signals GGem to the emission lines EM.

<1.4.2 Configuration of the Unit Circuit>

Figure 12:
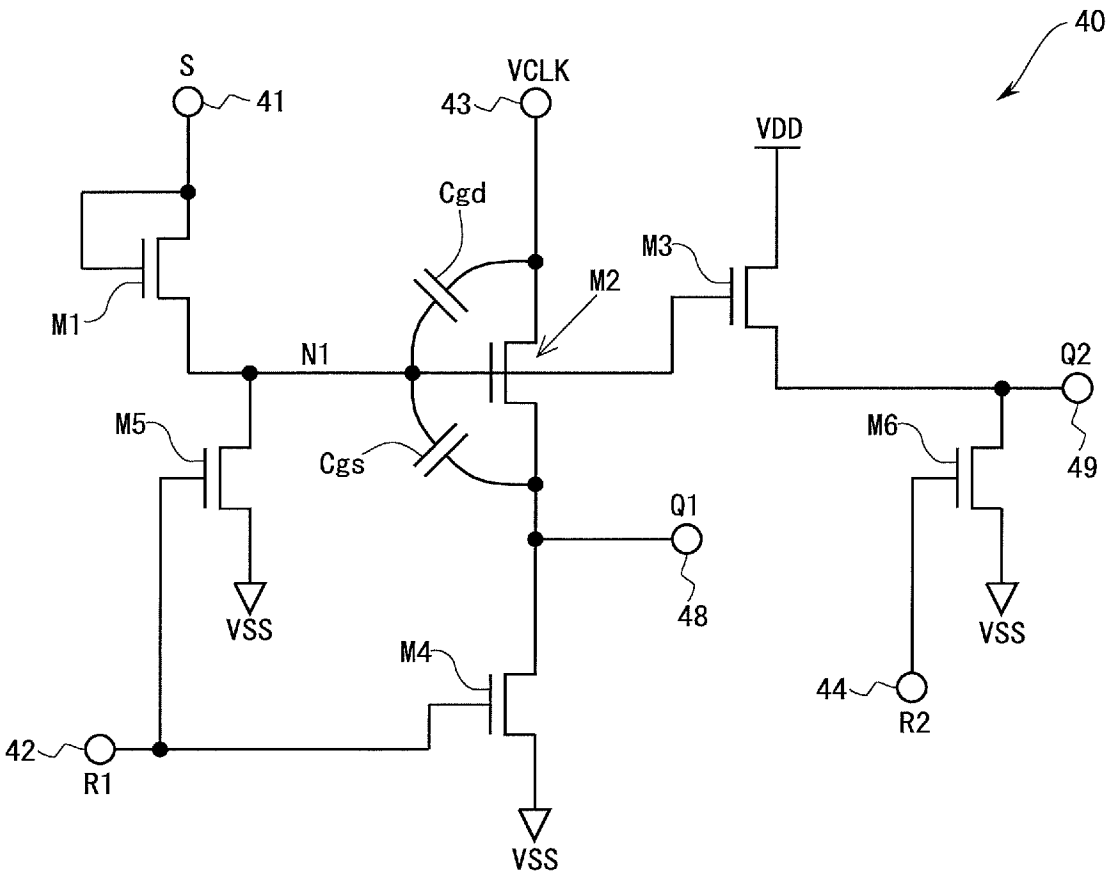
FIG. 12 is a circuit diagram showing a configuration of a unit circuit in a shift register composing the emission driver (a configuration of a portion of the shift register for one stage) in the first embodiment.

FIG. 12 is a circuit diagram showing a configuration of a unit circuit 40 in the shift register 4 composing the emission driver 400 (a configuration of a portion of the shift register 4 for one stage). As shown in FIG. 12, the unit circuit 40 includes six transistors M1 to M6. In addition, the unit circuit 40 has four input terminals 41 to 44 and two output terminals 48 and 49, in addition to an input terminal for a high-level power supply voltage VDD and input terminals for a low-level power supply voltage VSS. Here, an input terminal that receives a set signal S is denoted by reference character 41, an input terminal that receives a first reset signal R1 is denoted by reference character 42, an input terminal that receives a clock signal VCLK is denoted by reference character 43, and an input terminal that receives a second reset signal R2 is denoted by reference character 44. In addition, an output terminal that outputs a first output signal Q1 is denoted by reference character 48, and an output terminal that outputs a second output signal Q2 is denoted by reference character 49. A parasitic capacitance Cgd is formed between the gate and drain terminals of the transistor M2, and a parasitic capacitance Cgs is formed between the gate and source terminals of the transistor M2. The source terminal of the transistor M1, the gate terminal of the transistor M2, the gate terminal of the transistor M3, and the drain terminal of the transistor M5 are connected to one another. Note that a region (a wiring line) where they are connected to one another is hereinafter referred to as "first node". The first node is denoted by reference character N1.

The transistor M1 is connected at its gate and drain terminals to the input terminal 41 (i.e., diode-connected), and connected at its source terminal to the first node N1. The transistor M2 is connected at its gate terminal to the first node N1, connected at its drain terminal to the input terminal 43, and connected at its source terminal to the output terminal 48. The transistor M3 is connected at its gate terminal to the first node N1, connected at its drain terminal to the input terminal for the high-level power supply voltage VDD, and connected at its source terminal to the output terminal 49. The transistor M4 is connected at its gate terminal to the input terminal 42, connected at its drain terminal to the output terminal 48, and connected at its source terminal to the input terminal for the low-level power supply voltage VSS. The transistor M5 is connected at its gate terminal to the input terminal 42, connected at its drain terminal to the first node N1, and connected at its source terminal to the input terminal for the low-level power supply voltage VSS. The transistor M6 is connected at its gate terminal to the input terminal 44, connected at its drain terminal to the output terminal 49, and connected at its source terminal to the input terminal for the low-level power supply voltage VSS.

Next, the functions of the components in the unit circuit 40 will be described. The transistor M1 changes the potential of the first node N1 toward a high level when the set signal S goes to a high level. The transistor M2 provides the potential of the clock signal VCLK to the output terminal 48 when the potential of the first node N1 goes to a high level. The transistor M3 provides the potential of the high-level power supply voltage VDD to the output terminal 49 when the potential of the first node N1 goes to a high level. The transistor M4 changes the potential of the output terminal 48 toward the potential of the low-level power supply voltage VSS when the first reset signal R1 goes to a high level. The transistor M5 changes the potential of the first node N1 toward the potential of the low-level power supply voltage VSS when the first reset signal R1 goes to a high level. The transistor M6 changes the potential of the output terminal 49 toward the potential of the low-level power supply voltage VSS when the second reset signal R2 goes to a high level.

Note that in the present embodiment a first transistor is implemented by the transistor M1, a second transistor is implemented by the transistor M2, a third transistor is implemented by the transistor M3, a fourth transistor is implemented by the transistor M4, a fifth transistor is implemented by the transistor M5, and a sixth transistor is implemented by the transistor M6. In addition, a first output node is implemented by the output terminal 48, and a second output node is implemented by the output terminal 49. In addition, an other-stage control signal is implemented by the first output signal Q1 which is outputted from the output terminal 48.

<1.4.3 Operation of the Unit Circuit>

Figure 13:
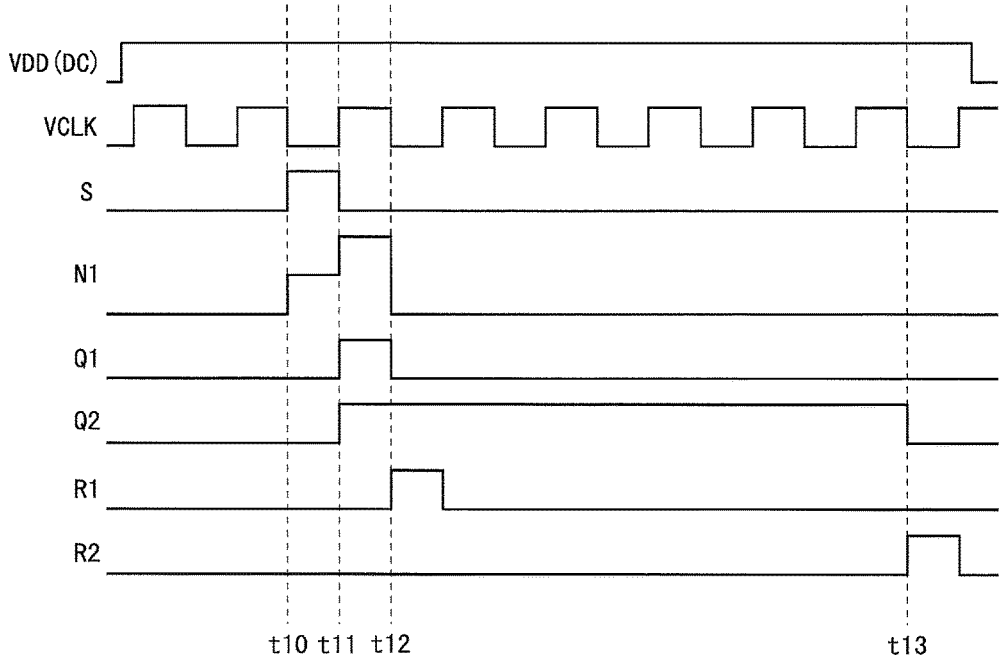
FIG. 13 is a timing chart for describing the operation of the unit circuit in the first embodiment.

Next, the operation of the unit circuit 40 of the present embodiment will be described with reference to FIGS. 12 and 13. As shown in FIG. 13, during a period before time point t10, the potential of the first node N1, the potential of the first output signal Q1 (the potential of the output terminal 48), and the potential of the second output signal Q2 (the potential of the output terminal 49) are at a low level. In addition, the clock signal VCLK which goes to a high level every predetermined period is provided to the input terminal 43. Note that although some delay occurs in actual waveforms, FIG. 13 shows ideal waveforms.

At time point t10, a pulse of the set signal S is provided to the input terminal 41. Since the transistor M1 is diode-connected as shown in FIG. 12, the transistor M1 goes into an on state by the pulse of the set signal S. By this, the potential of the first node N1 increases.

At time point t11, the clock signal VCLK changes from a low level to a high level. At this time, since the first reset signal R1 is at a low level, the transistor M5 is in an off state. Therefore, the first node N1 goes into a floating state. As described above, the parasitic capacitance Cgd is formed between the gate and drain terminals of the transistor M2, and the parasitic capacitance Cgs is formed between the gate and source terminals of the transistor M2. Hence, due to the bootstrap effect, the potential of the first node N1 greatly increases. As a result, a high voltage is applied to the transistor M2 and the transistor M3. By this, the potential of the first output signal Q1 (the potential of the output terminal 48) increases to the high-level potential of the clock signal VCLK, and the potential of the second output signal Q2 (the potential of the output terminal 49) increases to the potential of the high-level power supply voltage VDD. Note that during the period of time point t11 to time point t12, the first reset signal R1 is at a low level. Hence, since the transistor M4 is maintained in an off state, the potential of the first output signal Q1 does not decrease during this period. In addition, during the period of time point t11 to time point t12, the second reset signal R2 is at a low level. Hence, since the transistor M6 is maintained in an off state, the potential of the second output signal Q2 does not decrease during this period.

At time point t12, the clock signal VCLK changes from the high level to a low level. By this, with a decrease in the potential of the input terminal 43, the potential of the first output signal Q1 decreases, and furthermore, the potential of the first node N1 also decreases through the parasitic capacitances Cgd and Cgs. In addition, at time point t12, a pulse of the first reset signal R1 is provided to the input terminal 42. By this, the transistor M4 and the transistor M5 go into an on state. By the transistor M4 going into an on state, the potential of the first output signal Q1 decreases to a low level, and by the transistor M5 going into an on state, the potential of the first node N1 decreases to a low level. Note that although the transistor M3 goes into an off state by the decrease in the potential of the first node N1 to a low level, the second reset signal R2 is maintained at the low level until time point t13. Therefore, during the period of time point t12 to time point t13, the output terminal 49 is maintained in a floating state, and the potential of the second output signal Q2 is maintained at the potential of the high-level power supply voltage VDD.

At time point t13, a pulse of the second reset signal R2 is provided to the input terminal 44. By this, the transistor M6 goes into an on state. As a result, the potential of the second output signal Q2 decreases to a low level. Note that a pulse of a subframe reset signal SUBF_RST serving as the second reset signal R2 is provided to each unit circuit 40 at the end time point of each subframe. That is, time point t13 in FIG. 13 corresponds to the end time point of each subframe.

1.5 Drive Method

Figure 14:
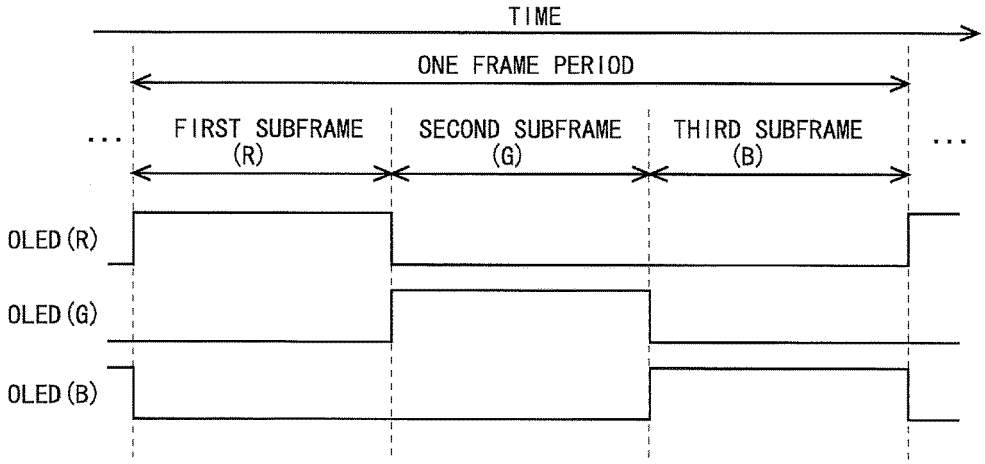
FIG. 14 is a diagram showing a configuration of one frame period of the first embodiment.

Next, a drive method of the present embodiment will be described on the basis of the above-described operation of the components. FIG. 14 is a diagram showing a configuration of one frame period in the present embodiment. As shown in FIG. 14, one frame period is composed of three subframes (first to third subframes). The first subframe is a subframe for performing red screen display. That is, in the first subframe, the organic EL elements OLED(R) emit light. The second subframe is a subframe for performing green screen display. That is, in the second subframe, the organic EL elements OLED(G) emit light. The third subframe is a subframe for performing blue screen display. That is, in the third subframe, the organic EL elements OLED(B) emit light. During the operation of the organic EL display device 1, the first to third subframes are repeated. By this, a red screen, a green screen, and a blue screen are repeatedly displayed, by which desired color display is performed.

Figure 15:
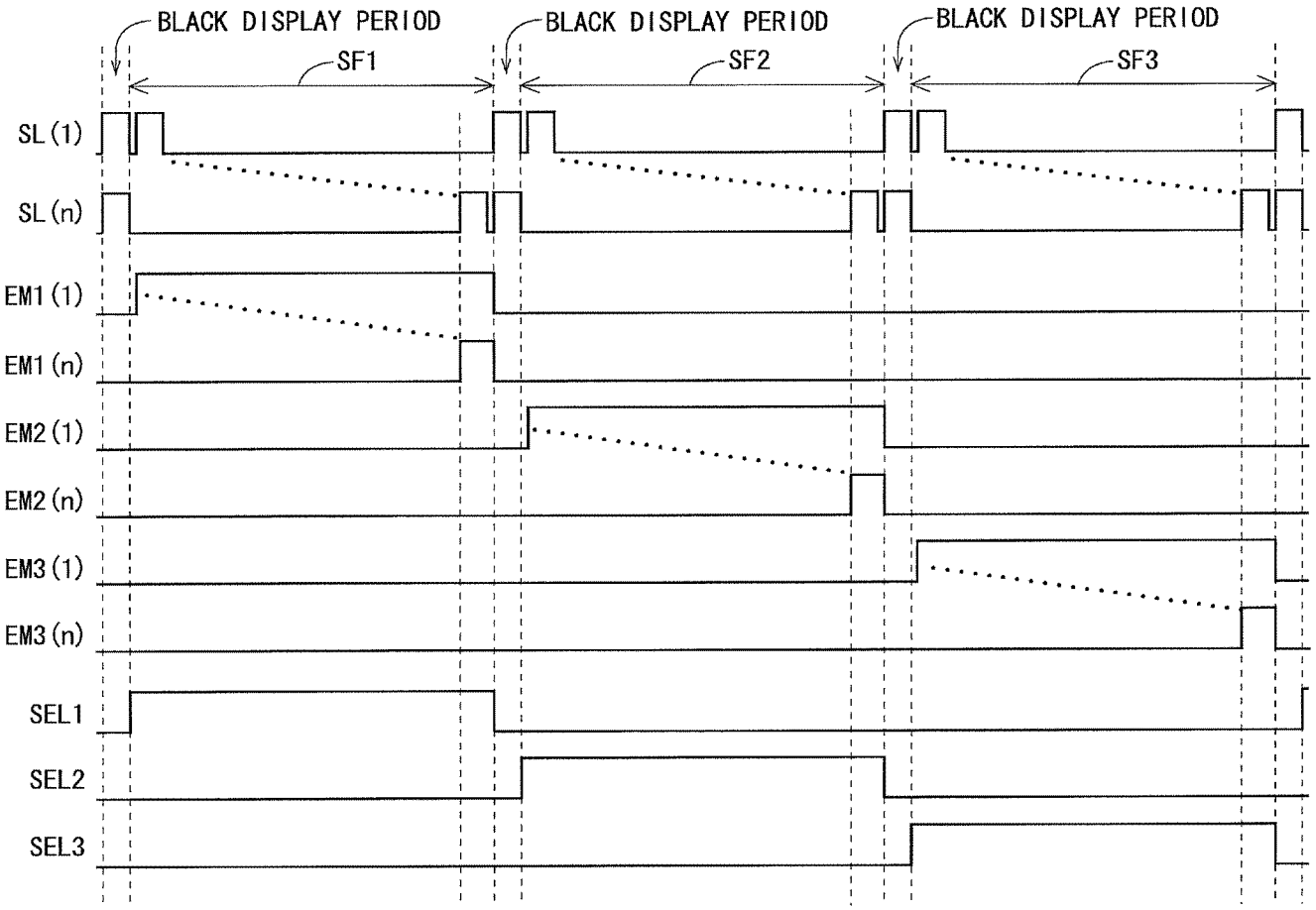
FIG. 15 is a timing chart showing the waveforms of scanning signals provided to scanning signal lines, light-emission enable signals provided to emission lines, and selection signals in the first embodiment.

FIG. 15 is a timing chart showing the waveforms of scanning signals provided to the scanning signal lines SL, light-emission enable signals provided to the emission lines EM, and selection signals SEL1 to SEL3. Note that in FIG. 15 the first to third subframes are indicated by reference characters SF1 to SF3, respectively. As shown in FIG. 15, a flyback period between two consecutive subframes is a black display period. During the black display period, all the emission lines EM are brought into a non-selected state, and all the scanning signal lines SL(1) to SL(n) are brought into a selected state. In such a state, the source driver 200 applies analog voltages corresponding to a black color, as driving video signals, to all the data lines DL(1) to DL(m). By this, image data corresponding to a black color is written to all the pixel circuits 50 in the display unit 500. In addition, all the organic EL elements OLED in the display unit 500 go into a light-off state by all the emission lines EM brought into a non-selected state, and thus, a black screen is displayed on the display unit 500. By performing writing of image data corresponding to a black color during the black display periods (flyback periods) in the above-described manner, the organic EL elements OLED are prevented from emitting light at luminance determined according to writing performed in the preceding subframe in each subframe.

In the first subframe SF1, first, the emission signal input switching circuit 600 brings the selection signal SEL1 to a high level, and brings the selection signal SEL2 and the selection signal SEL3 to a low level. By this, in each row, the transistor Tem1 goes into an on state and the transistor Tem2 and the transistor Tem3 go into an off state. Then, the gate driver 300 brings a scanning signal for the first row to a high level, and the emission driver 400 brings a light-emission enable signal for the first row to a high level. Since only the transistor Tem1 among the transistors Tem1 to Tem3 is in an on state, the first emission line EM1(1) goes into a selected state in the first row. By this, in each pixel circuit 50 in the first row, the transistor T3 goes into an on state and the transistor T4 and the transistor T5 go into an off state. In addition, by the scanning signal line SL(1) in the first row going into a selected state, the transistor T2 goes into an on state in each pixel circuit 50 in the first row. As a result, in each pixel circuit 50 in the first row, the capacitor Cst is charged based on a data voltage applied to a corresponding data line DL.

When the gate driver 300 brings the scanning signal line SL(1) in the first row into anon-selected state, the transistor T2 goes into an off state in each pixel circuit 50 in the first row. By this, a gate-source voltage Vgs held in the capacitor Cst is fixed. In each pixel circuit 50 in the first row, a drive current according to the magnitude of the gate-source voltage Vgs flows between the drain and source of the transistor T1. Since the transistor T3 is in an on state in the first subframe SF1 as described above, the drive current is supplied to the organic EL element OLED(R) through the transistor T3 in each pixel circuit 50 in the first row. As a result, the organic EL element OLED(R) emits light in each pixel circuit 50 in the first row. Meanwhile, as described above, a pulse of the subframe reset signal SUBF_RST is provided to the unit circuits 40 in the shift register 4 at the end time point of each subframe. Therefore, the first emission line EM1(1) in the first row is maintained in the selected state until the end time point of the first subframe SF1. Operation such as that described above is sequentially performed for the second to nth rows.

In the second subframe SF2, the emission signal input switching circuit 600 brings the selection signal SEL2 to a high level, and brings the selection signal SEL1 and the selection signal SEL3 to a low level. Hence, in each row, the transistor Tem2 goes into an on state and the transistor Tem1 and the transistor Tem3 go into an off state. In such a state, in the same manner as in the first subframe SF1, the scanning signals for the respective rows are sequentially brought to a high level, and the light-emission enable signals for the respective rows are sequentially brought to a high level. In each pixel circuit 50, the transistor T4 goes into an on state and the transistor T3 and the transistor T5 go into an off state. By the above, in the second subframe SF2, the organic EL element OLED(G) emits light in each pixel circuit 50.

In the third subframe SF3, the emission signal input switching circuit 600 brings the selection signal SEL3 to a high level, and brings the selection signal SEL1 and the selection signal SEL2 to a low level. Hence, in each row, the transistor Tem3 goes into an on state and the transistor Tem1 and the transistor Tem2 go into an off state. In such a state, in the same manner as in the first subframe SF1, the scanning signals for the respective rows are sequentially brought to a high level, and the light-emission enable signals for the respective rows are sequentially brought to a high level. In each pixel circuit 50, the transistor T5 goes into an on state and the transistor T3 and the transistor T4 go into an off state. By the above, in the third subframe SF3, the organic EL element OLED(B) emits light in each pixel circuit 50.

1.6 Effects

According to the present embodiment, the transistors Tem1 to Tem3 that control the supply of a light-emission enable signal GGem which is outputted from the emission driver 400, to the emission lines EM are provided between the emission driver 400 and the emission lines EM (the first to third emission lines EM1 to EM3). In such a configuration, one of the transistors Tem1 to Tem3 is brought into an on state in each subframe, and each of the transistors Tem1 to Tem3 is brought into an on state once during one frame period. Hence, the light-emission enable signal GGem outputted from the emission driver 400 is supplied to different emission lines EM in different subframes. Therefore, unlike the conventional art, as a driver for generating a light-emission enable signal GGem, it is only necessary to provide the emission driver 400 for one system. By this, the number of transistors required to control the light emission of the organic EL elements OLED is reduced over conventional devices.

Figure 16:
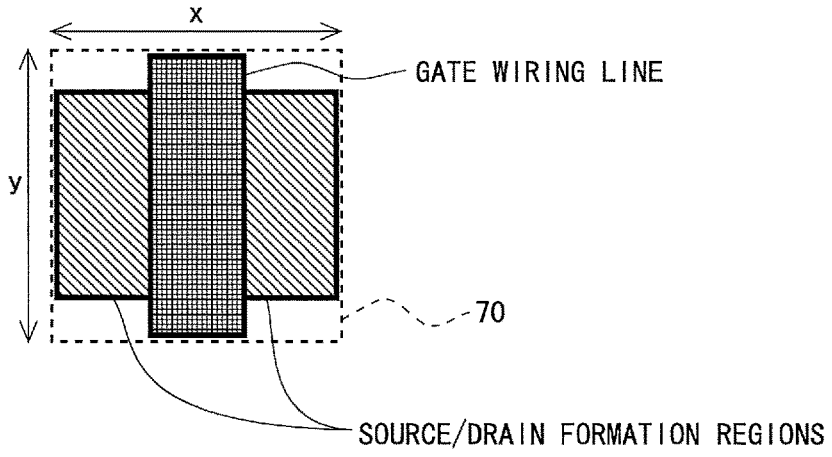
FIG. 16 is a diagram for describing an effect of the first embodiment.
Figure 17:
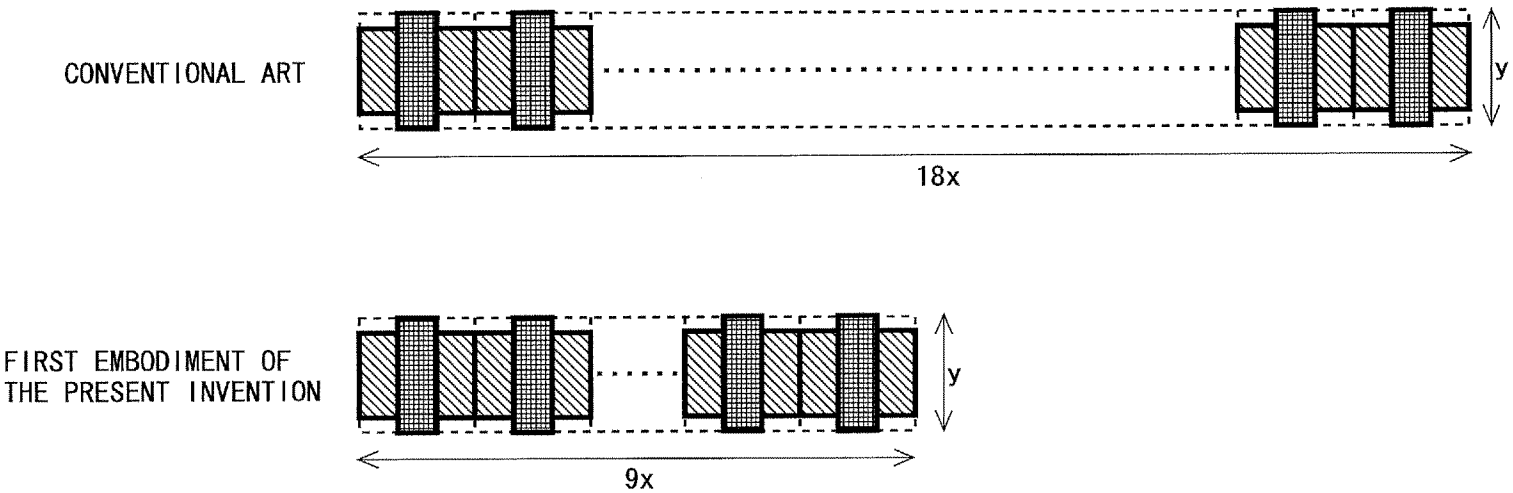
FIG. 17 is a diagram for describing the effect of the first embodiment.

Next, effects of the present embodiment will be quantitatively described. For example, when focusing on an organic EL display device that adopts time-division driving where one frame period is divided into three subframes, according to the conventional art, emission drivers 400 for three systems are required. When focusing on an emission driver 400 for one system, as can be grasped from FIG. 12, six transistors M1 to M6 are required for one row. Therefore, according to the conventional art, 18 transistors are required for one row. On the other hand, according to the present embodiment, although three transistors Tem1 to Tem3 are additionally required between the emission driver 400 and the emission lines EM, it is only necessary to provide an emission driver 400 for one system. Therefore, according to the present embodiment, nine transistors are required for one row. Here, as shown in FIG. 16, a rectangular region including a gate wiring line and source/drain regions is defined as a TFT occupied region 70. In addition, the lengths of the sides of the TFT occupied region 70 are x and y, as shown in FIG. 16. Then, as shown in FIG. 17, while the TFT occupied area of the conventional art is 18xy, the TFT occupied area of the present embodiment is 9xy. Therefore, the ratio of the TFT occupied area of the present embodiment to the TFT occupied area of the conventional art (TFT occupied area ratio) P1 is as follows:

$$P1 = (9xy/18xy) \times 100$$
$$= 50(\%)$$

As such, according to the present embodiment, the TFT occupied area is 50 percent compared to that of the conventional art.

By the above, according to the present embodiment, since the picture-frame size of an organic EL display device can be reduced over conventional devices, miniaturization of the organic EL display device is achieved. In addition, when focusing on a panel of a certain size, definition improvement (high resolution) such as FHD of an HD panel and WQHD of an FHD panel can be achieved. Note that although here the effects are described focusing only on the TFT occupied area, in practice, the occupied areas by connection wiring lines between the TFTs in the emission driver 400 and by contact portions are also reduced over conventional devices.

In addition, in the present embodiment, for the transistors in the circuits, oxide TFTs (transistors using an oxide semiconductor for a channel layer) such as TFTs having an In—Ga—Zn—O-based semiconductor layer are adopted. Hence, miniaturization of the TFTs in the circuits is possible, facilitating definition improvement of a panel.

1.7 Variants

Variants of the above-described first embodiment will be described below.

<1.7.1 First Variant>

Although six transistors M1 to M6 are included in each unit circuit 40 in the shift register 4 composing the emission driver 400 in the above-described first embodiment, the present invention is not limited thereto. In general, to achieve an improvement in drive performance and an improvement in reliability, nine or more transistors are included in each unit circuit 40. Hence, as a first variant, an example in which nine transistors are included in each unit circuit 40 will be described. Note that a specific circuit configuration of the unit circuits 40 is not particularly limited, either.

Figure 18:
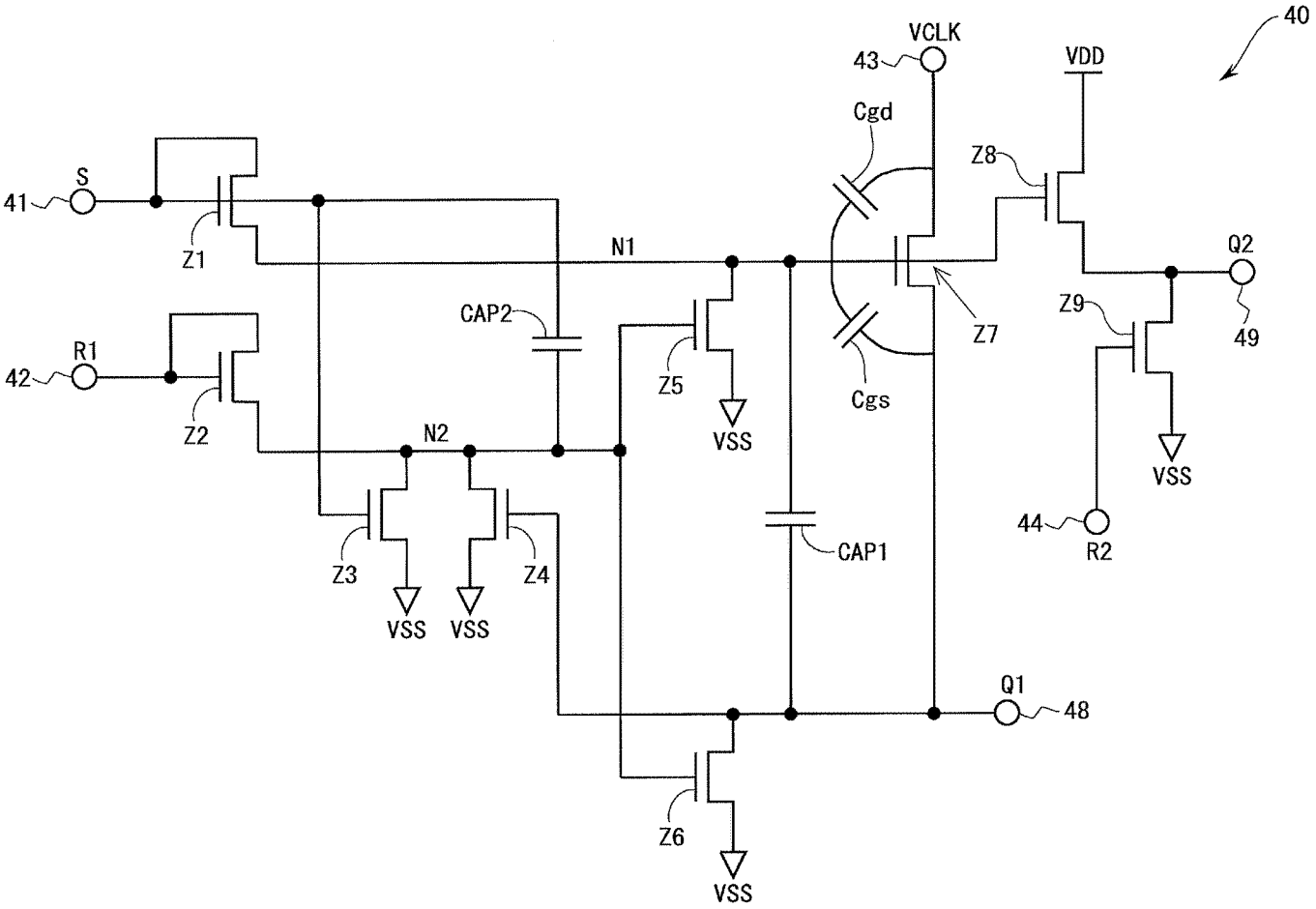
FIG. 18 is a circuit diagram showing a configuration of a unit circuit in the shift register composing the emission driver (a configuration of a portion of the shift register for one stage) in a first variant of the first embodiment.

FIG. 18 is a circuit diagram showing a configuration of a unit circuit 40 (a configuration of a portion of the shift register 4 for one stage) of the present variant. As shown in FIG. 18, the unit circuit 40 includes nine transistors Z1 to Z9 and two capacitors CAP1 and CAP2. In addition, the unit circuit 40 has four input terminals 41 to 44 and two output terminals 48 and 49, in addition to an input terminal for a high-level power supply voltage VDD and input terminals for a low-level power supply voltage VSS. A parasitic capacitance Cgd is formed between the gate and drain terminals of the transistor Z7, and a parasitic capacitance Cgs is formed between the gate and source terminals of the transistor Z7.

The source terminal of the transistor Z1, the drain terminal of the transistor Z5, the gate terminal of the transistor Z7, the gate terminal of the transistor Z8, and one end of the capacitor CAP1 are connected to one another. Note that a region (a wiring line) where they are connected to one another is referred to as "first node" for convenience sake. The first node is denoted by reference character N1. The source terminal of the transistor Z2, the drain terminal of the transistor Z3, the drain terminal of the transistor Z4, the gate terminal of the transistor Z5, the gate terminal of the transistor Z6, and one end of the capacitor CAP2 are connected to one another. Note that a region (a wiring line) where they are connected to one another is referred to as "second node" for convenience sake. The second node is denoted by reference character N2.

The transistor Z1 is connected at its gate and drain terminals to the input terminal 41 (i.e., diode-connected), and connected at its source terminal to the first node N1. The transistor Z2 is connected at its gate and drain terminals to the input terminal 42 (i.e., diode-connected), and connected at its source terminal to the second node N2. The transistor Z3 is connected at its gate terminal to the input terminal 41, connected at its drain terminal to the second node N2, and connected at its source terminal to the input terminal for the low-level power supply voltage VSS. The transistor Z4 is connected at its gate terminal to the output terminal 48, connected at its drain terminal to the second node N2, and connected at its source terminal to the input terminal for the low-level power supply voltage VSS. The transistor Z5 is connected at its gate terminal to the second node N2, connected at its drain terminal to the first node N1, and connected at its source terminal to the input terminal for the low-level power supply voltage VSS. The transistor Z6 is connected at its gate terminal to the second node N2, connected at its drain terminal to the output terminal 48, and connected at its source terminal to the input terminal for the low-level power supply voltage VSS. The transistor Z7 is connected at its gate terminal to the first node N1, connected at its drain terminal to the input terminal 43, and connected at its source terminal to the output terminal 48. The transistor Z8 is connected at its gate terminal to the first node N1, connected at its drain terminal to the input terminal for the high-level power supply voltage VDD, and connected at its source terminal to the output terminal 49. The transistor Z9 is connected at its gate terminal to the input terminal 44, connected at its drain terminal to the output terminal 49, and connected at its source terminal to the input terminal for the low-level power supply voltage VSS. The capacitor CAP1 is connected at its one end to the first node N1 and connected at its other end to the output terminal 48. The capacitor CAP2 is connected at its one end to the second node N2 and connected at its other end to the input terminal 41.

Next, the functions of the components in the unit circuit 40 will be described. The transistor Z1 changes the potential of the first node N1 toward a high level when a set signal S goes to a high level. The transistor Z2 changes the potential of the second node N2 toward a high level when a first reset signal R1 goes to a high level. The transistor Z3 changes the potential of the second node N2 toward the potential of the low-level power supply voltage VSS when the set signal S goes to a high level. The transistor Z4 changes the potential of the second node N2 toward the potential of the low-level power supply voltage VSS when the potential of the output terminal 48 goes to a high level. The transistor Z5 changes the potential of the first node N1 toward the potential of the low-level power supply voltage VSS when the potential of the second node N2 goes to a high level. The transistor Z6 changes the potential of the output terminal 48 toward the potential of the low-level power supply voltage VSS when the potential of the second node N2 goes to a high level. The transistor Z7 provides the potential of a clock signal VCLK to the output terminal 48 when the potential of the first node N1 goes to a high level. The transistor Z8 provides the potential of the high-level power supply voltage VDD to the output terminal 49 when the potential of the first node N1 goes to a high level. The transistor Z9 changes the potential of the output terminal 49 toward the potential of the low-level power supply voltage VSS when a second reset signal R2 goes to a high level. The capacitor CAP1 functions as a compensation capacitance for maintaining the potential of the first node N1 at a high level during a period during which the potential of the output terminal 48 is at a high level. The capacitor CAP2 functions to reduce the potential of the second node N2 to stabilize circuit operation when the potential of the output terminal 48 goes to a high level.

Next, the operation of the unit circuits 40 of the present variant will be described with reference to FIGS. 13 and 18. At time point t10, a pulse of the set signal S is provided to the input terminal 41. Since the transistor Z1 is diode-connected as shown in FIG. 18, the transistor Z1 goes into an on state by the pulse of the set signal S. By this, the capacitor CAP1 is charged (here, precharged) and the potential of the first node N1 increases. In addition, the transistor Z3 goes into an on state by the pulse of the set signal S and the potential of the second node N2 goes to a low level. By this, the transistor Z5 and the transistor Z6 go into an off state. By the above, during the period of time point t10 to time point t11, the potential of the second node N2 goes to a low level with the pulse of the set signal S being input, and thus, the capacitor CAP2 is charged based on the potential difference between the input terminal 41 and the second node N2.

At time point t11, the clock signal VCLK changes from a low level to a high level. At this time, since the potential of the second node N2 is at a low level, the transistor Z5 is in an off state. Therefore, the first node N1 goes into a floating state. In addition, as described above, the parasitic capacitance Cgd is formed between the gate and drain terminals of the transistor Z7, and the parasitic capacitance Cgs is formed between the gate and source terminals of the transistor Z7. By the above, due to the bootstrap effect, the potential of the first node N1 greatly increases. As a result, a high voltage is applied to the transistor Z7 and the transistor Z8. By this, the potential of a first output signal Q1 (the potential of the output terminal 48) increases to the high-level potential of the clock signal VCLK, and the potential of a second output signal Q2 (the potential of the output terminal 49) increases to the potential of the high-level power supply voltage VDD. Meanwhile, in the transistor Z5 and the transistor Z6, too, parasitic capacitances are present between the gate and drain terminals. Thus, with the increase in the potential of the first node N1 and the potential of the first output signal Q1, the potential of the second node N2 is going to increase. However, due to the fact that the capacitor CAP2 is charged based on the potential difference between the input terminal 41 and the second node N2 during the period of time point t10 to time point 11, and that the set signal S changes from the high level to the low level at time point 11, the potential of the second node N2 is maintained at the low level. In addition, by the increase in the potential of the first output signal Q1 to the high-level potential of the clock signal VCLK, the transistor Z4 goes into an on state. By this, too, the potential of the second node N2 is maintained at the low level.

At time point t12, the clock signal VCLK changes from the high level to the low level. By this, with a decrease in the potential of the input terminal 43, the potential of the first output signal Q1 decreases, and furthermore, the potential of the first node N1 also decreases through the parasitic capacitances Cgd and Cgs. In addition, at time point t12, a pulse of the first reset signal R1 is provided to the input terminal 42. Hence, the transistor Z2 goes into an on state, and the potential of the second node N2 goes to a high level. By this, the transistor Z5 and the transistor Z6 go into an on state. As a result, the potential of the first node N1 and the potential of the first output signal Q1 decrease to a low level. Note that although the transistor Z8 goes into an off state by the decrease in the potential of the first node N1 to a low level, the second reset signal R2 is maintained at the low level until time point t13. Therefore, during the period of time point t12 to time point t13, the output terminal 49 is maintained in a floating state, and the potential of the second output signal Q2 is maintained at the potential of the high-level power supply voltage VDD.

Figure 19:
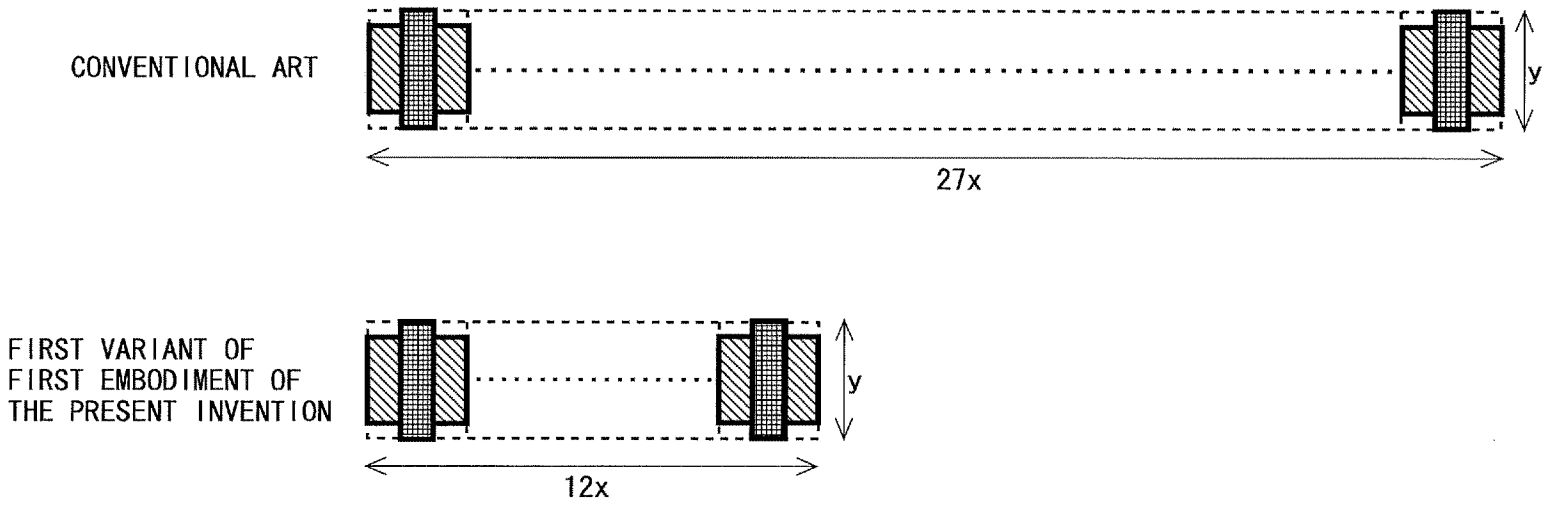
FIG. 19 is a diagram for describing an effect of the first variant of the first embodiment.

As described above, in the present variant, the shift register 4 in the emission driver 400 is composed of the unit circuits 40 each including nine transistors Z1 to Z9. Effects of the present variant for the case of premising that such unit circuits 40 are adopted will be quantitatively described below. For example, when focusing on an organic EL display device that adopts time-division driving where one frame period is divided into three subframes, according to the conventional art, emission drivers 400 for three systems are required. When focusing on an emission driver 400 for one system, as can be grasped from FIG. 18, nine transistors Z1 to Z9 are required for one row. Therefore, according to the conventional art, 27 transistors are required for one row. On the other hand, according to the present variant, although three transistors Tem1 to Tem3 are additionally required between the emission driver 400 and the emission lines EM, it is only necessary to provide an emission driver 400 for one system. Therefore, according to the present variant, 12 transistors are required for one row. By the above, as shown in FIG. 19, while the TFT occupied area of the conventional art is 27xy, the TFT occupied area of the present variant is 12xy. Therefore, the ratio of the TFT occupied area of the present variant to the TFT occupied area of the conventional art (TFT occupied area ratio) P2 is as follows:

$$P2 = (12xy/27xy) \times 100$$
$$= 44(\%)$$

That is, according to the present variant, the TFT occupied area is 44 percent compared to that of the conventional art. As such, the larger the number of transistors composing the shift register 4 in the emission driver 400, the larger the effect of a reduction in TFT occupied area.

<1.7.2 Second Variant>

Figure 20:
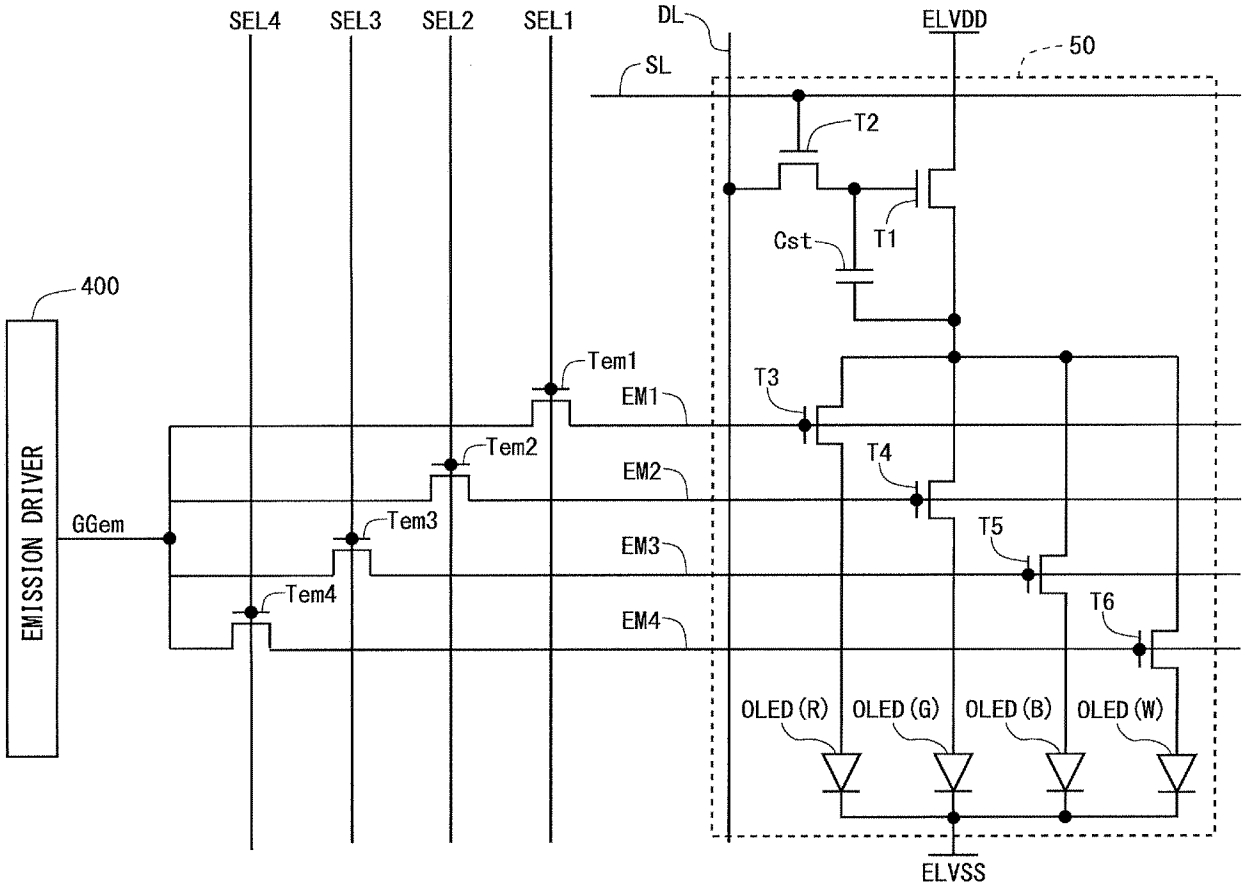
FIG. 20 is a circuit diagram showing a configuration of a main part (a configuration of a portion between a pixel circuit and the emission driver) in a second variant of the first embodiment.

In the above-described first embodiment, each pixel circuit 50 includes three organic EL elements OLED(R), OLED(G), and OLED(B), and one frame period is divided into three subframes. However, the present invention is not limited thereto, and one frame period may be divided into four or more subframes. For example, even when each pixel circuit 50 includes four organic EL elements OLED(R), OLED(G), OLED(B), and OLED(W) as shown in FIG. 20 and one frame period is divided into four subframes, the present invention can be applied. This also applies to second to fourth embodiments which will be described later. Note that the organic EL element OLED(W) functions as an electro-optical element that emits white light.

As shown in FIG. 20, in the present variant, each pixel circuit 50 is provided with a transistor T6 serving as a light-emission control transistor that performs light emission control by controlling the supply of a drive current to the organic EL element OLED(W). In addition, a fourth emission line EM4 is disposed in the display unit 500, in addition to the first to third emission lines EM1 to EM3. Between the fourth emission line EM4 and the emission driver 400 there is provided a transistor Tem4 whose on/off state is controlled by a selection signal SEL4.

In a configuration such as that described above, one of the transistors Tem1 to Tem4 is brought into an on state in each subframe, and each of the transistors Tem1 to Tem4 is brought into an on state once during one frame period. For example, the transistor Tem1 is brought into an on state in a first subframe, the transistor Tem2 is brought into an on state in a second subframe, the transistor Tem3 is brought into an on state in a third subframe, and the transistor Tem4 is brought into an on state in a fourth subframe. By this, a red screen, a green screen, a blue screen, and a white screen are repeatedly displayed, by which desired color display is performed.

In the above-described manner, in an organic EL display device configured to include four organic EL elements OLED(R), OLED(G), OLED(B), and OLED(W) in each pixel circuit 50, too, the TFT occupied area can be reduced over conventional devices.

2. Second Embodiment

A second embodiment of the present invention will be described. Note that only differences from the above-described first embodiment will be described, and description of the same things as those of the above-described first embodiment is omitted. This also applies to a third embodiment and a fourth embodiment which will be described later.

<2.1 Configuration of Pixel Circuits>

Figure 21:
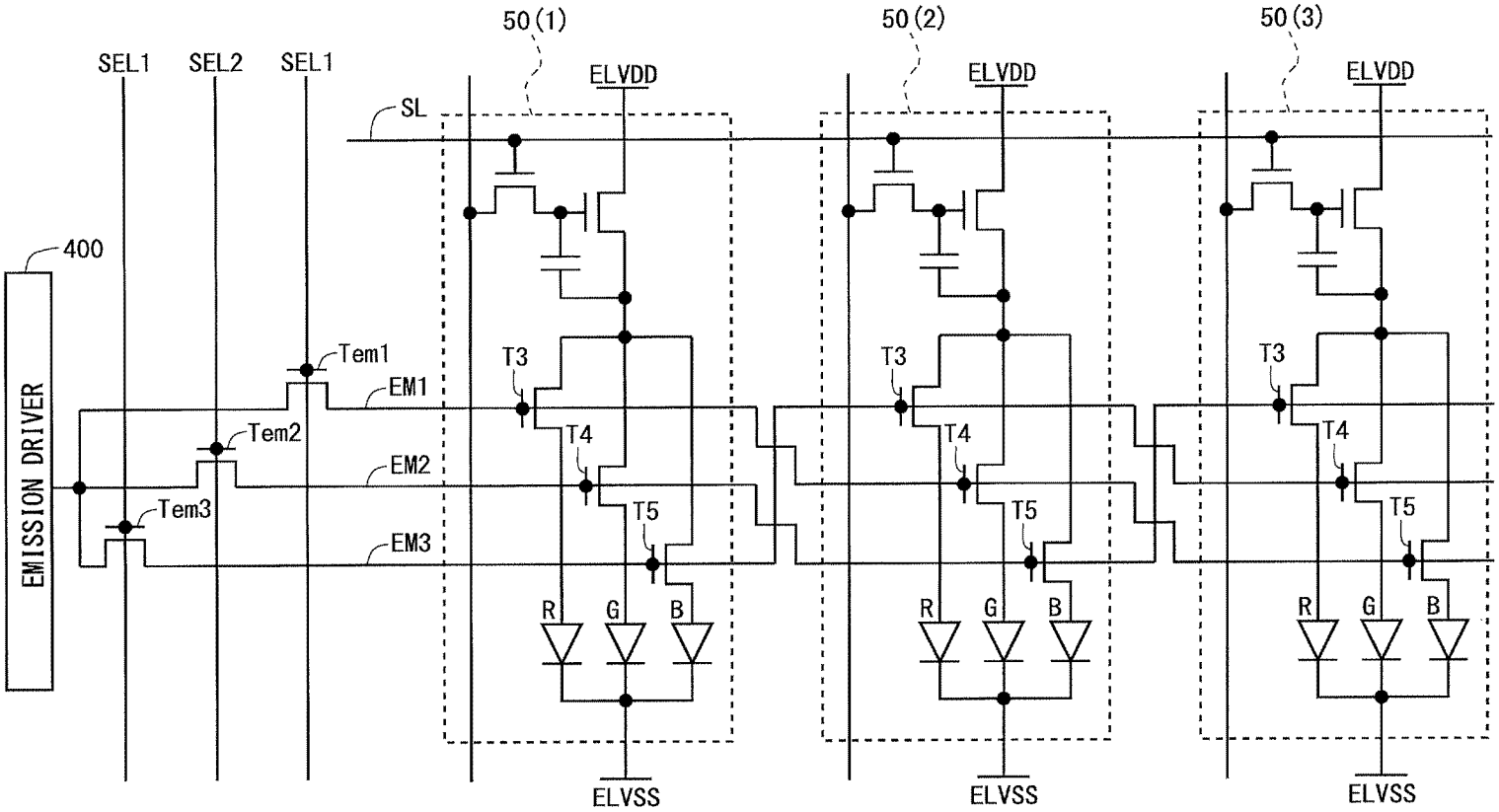
FIG. 21 is a diagram for describing a connection relationship between first to third emission lines and transistors T3 to T5 in an active matrix-type organic EL display device according to a second embodiment of the present invention.

In the present embodiment, three pixel circuits 50 arranged side by side in a direction in which scanning signal lines SL extend are defined as one group. Since the number of columns is m, (m/3) groups are formed for each row. FIG. 21 is a circuit diagram showing configurations of three pixel circuits 50(1) to 50(3) included in one group. The configuration of each pixel circuit 50 is the same as that of the above-described first embodiment (see FIG. 7). Here, a connection relationship between first to third emission lines EM1 to EM3 and the gate terminals of transistors T3 to T5 included in the three pixel circuits 50(1) to 50(3) will be described. The first emission line EM1 is connected to the gate terminal of the transistor T3 in the pixel circuit 50(1), the gate terminal of the transistor T4 in the pixel circuit 50(2), and the gate terminal of the transistor T5 in the pixel circuit 50(3). The second emission line EM2 is connected to the gate terminal of the transistor T4 in the pixel circuit 50(1), the gate terminal of the transistor T5 in the pixel circuit 50(2), and the gate terminal of the transistor T3 in the pixel circuit 50(3). The third emission line EM3 is connected to the gate terminal of the transistor T5 in the pixel circuit 50(1), the gate terminal of the transistor T3 in the pixel circuit 50(2), and the gate terminal of the transistor T4 in the pixel circuit 50(3). As such, each of the first to third emission lines EM1 to EM3 is connected to the gate terminals of transistors corresponding to organic EL elements OLED that emit light of different colors in the three pixel circuits 50(1) to 50(3).

<2.2 Drive Method>

In a configuration such as that described above, as with the above-described first embodiment, first to third subframes SF1 to SF3 are repeated (see FIG. 14). In the first subframe SF1, first, an emission signal input switching circuit 600 brings a selection signal SEL1 to a high level, and brings a selection signal SEL2 and a selection signal SEL3 to a low level. By this, in each row, the transistor Tem1 goes into an on state and the transistor Tem2 and the transistor Tem3 go into an off state. Then, a gate driver 300 brings a scanning signal for the first row to a high level, and an emission driver 400 brings a light-emission enable signal for the first row to a high level. Since only the transistor Tem1 among the transistors Tem1 to Tem3 is in an on state, a first emission line EM1(1) goes into a selected state in the first row. By this, in the first row, the transistor T3 goes into an on state and the transistor T4 and the transistor T5 go into an off state in the pixel circuit 50(1), the transistor T4 goes into an on state and the transistor T3 and the transistor T5 go into an off state in the pixel circuit 50(2), and the transistor T5 goes into an on state and the transistor T3 and the transistor T4 go into an off state in the pixel circuit 50(3) (see FIG. 21). In addition, by a scanning signal line SL(1) in the first row going into a selected state, a transistor T2 goes into an on state in each pixel circuit 50 in the first row. As a result, a capacitor Cst is charged based on a data voltage applied to a corresponding data line DL in each pixel circuit 50 in the first row.

When the gate driver 300 brings the scanning signal line SL(1) in the first row into a non-selected state, the transistor T2 goes into an off state in each pixel circuit 50 in the first row. By this, a gate-source voltage Vgs held in the capacitor Cst is fixed. In each pixel circuit 50 in the first row, a drive current according to the magnitude of the gate-source voltage Vgs flows between the drain and source of a transistor T1. As described above, the first emission line EM1(1) is connected to the gate terminal of the transistor T3 in the pixel circuit 50(1), the gate terminal of the transistor T4 in the pixel circuit 50(2), and the gate terminal of the transistor T5 in the pixel circuit 50(3). Therefore, the drive current is supplied to an organic EL element OLED(R) through the transistor T3 in the pixel circuit 50(1), the drive current is supplied to an organic EL element OLED(G) through the transistor T4 in the pixel circuit 50(2), and the drive current is supplied to an organic EL element OLED(B) through the transistor T5 in the pixel circuit 50(3). As a result, the organic EL element OLED(R) emits light in the pixel circuit 50(1), the organic EL element OLED(G) emits light in the pixel circuit 50(2), and the organic EL element OLED(B) emits light in the pixel circuit 50(3). Meanwhile, as described above, a pulse of a subframe reset signal SUBF_RST is provided to unit circuits 40 in a shift register 4 at the end time point of each subframe. Therefore, the first emission line EM1(1) in the first row is maintained in the selected state until the end time point of the first subframe SF1.

Operation such as that described above is sequentially performed for the second to nth rows. Furthermore, in the second subframe SF2 and the third subframe SF3, too, the same operation as that of the first subframe SF1 is performed. Note, however, that the emission signal input switching circuit 600 brings a selection signal SEL2 to a high level in the second subframe SF2, and the emission signal input switching circuit 600 brings a selection signal SEL3 to a high level in the third subframe SF3. Therefore, the second emission lines EM2 go into a selected state in the second subframe SF2, and the third emission lines EM3 go into a selected state in the third subframe SF3.

Figure 22:
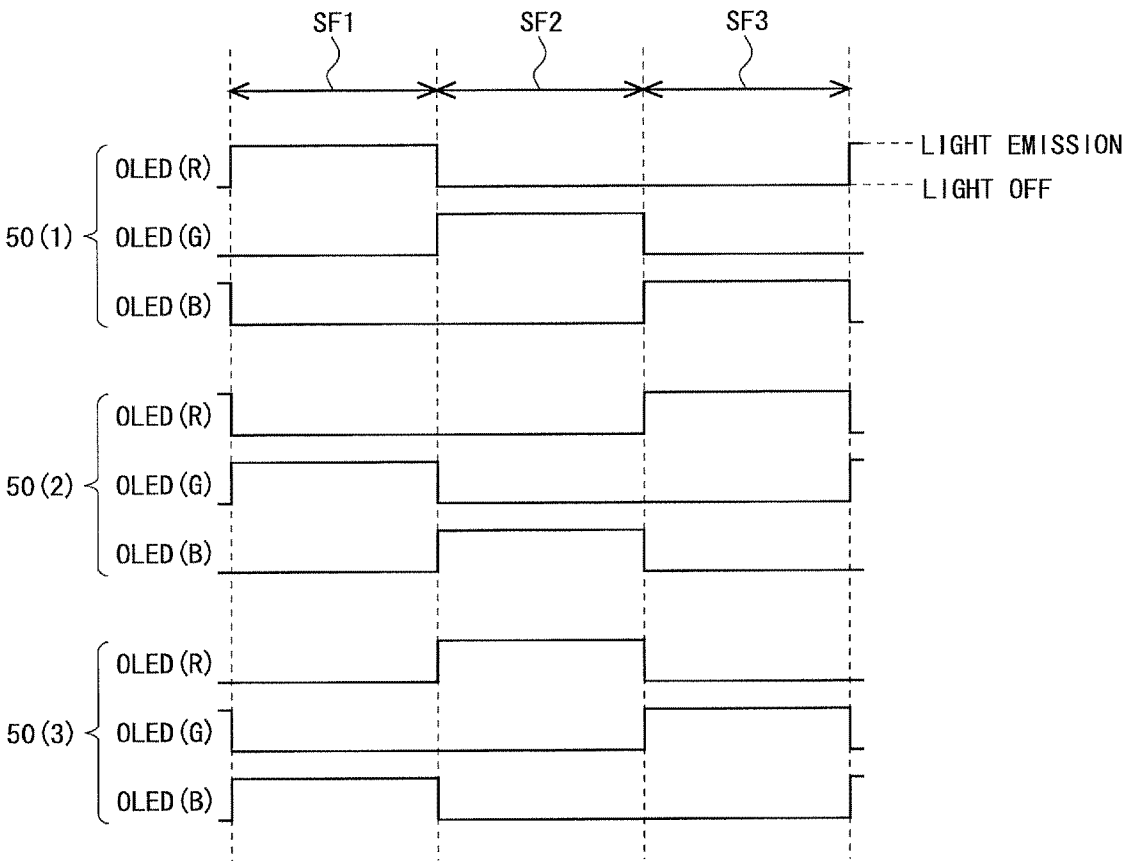
FIG. 22 is a diagram showing the transitions of the light-emitting states of organic EL elements in three pixel circuits included in one group during one frame period in the second embodiment.

By the above, the transitions of the light-emitting states of the organic EL elements OLED in the three pixel circuits 50(1) to 50(3) included in one group during one frame period are as follows (see FIG. 22). In the pixel circuit 50(1), only a red-color organic EL element OLED(R) goes into a light-emitting state in the first subframe SF1, only a green-color organic EL element OLED(G) goes into a light-emitting state in the second subframe SF2, and only a blue-color organic EL element OLED(B) goes into a light-emitting state in the third subframe SF3. In the pixel circuit 50(2), only a green-color organic EL element OLED(G) goes into a light-emitting state in the first subframe SF1, only a blue-color organic EL element OLED(B) goes into a light-emitting state in the second subframe SF2, and only a red-color organic EL element OLED(R) goes into a light-emitting state in the third subframe SF3. In the pixel circuit 50(3), only a blue-color organic EL element OLED(B) goes into a light-emitting state in the first subframe SF1, only a red-color organic EL element OLED(R) goes into a light-emitting state in the second subframe SF2, and only a green-color organic EL element OLED(G) goes into a light-emitting state in the third subframe SF3.

<2.3 Effects>

Figure 23:
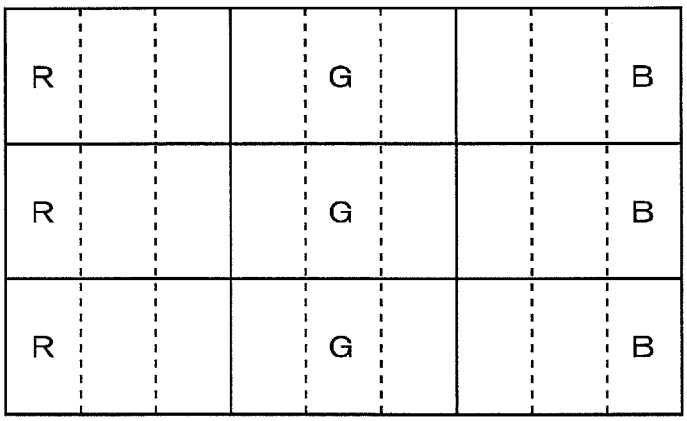
FIG. 23 is a diagram showing light-emitting states in a first subframe in the second embodiment.
Figure 24:
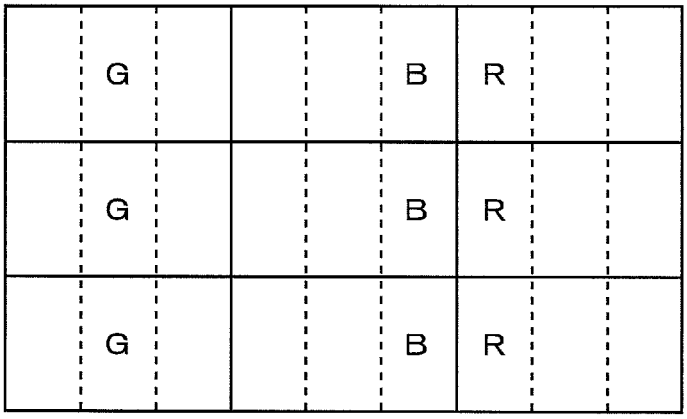
FIG. 24 is a diagram showing light-emitting states in a second subframe in the second embodiment.
Figure 25:
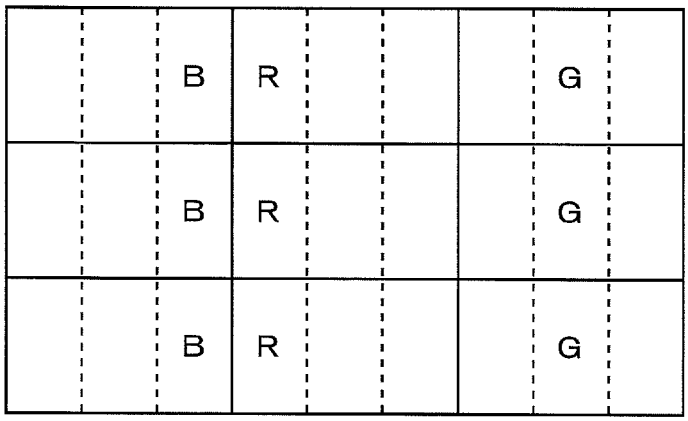
FIG. 25 is a diagram showing light-emitting states in a third subframe in the second embodiment.

According to the present embodiment, when focusing on pixel circuits 50 of three rows×three columns, the light-emitting states are such as those shown in FIG. 23 in the first subframe SF1, the light-emitting states are such as those shown in FIG. 24 in the second subframe SF2, and the light-emitting states are such as those shown in FIG. 25 in the third subframe SF3. That is, in each subframe, there are mixed light-emitting colors. By this, the occurrence of color breakup which is likely to occur when time-division driving (field sequential driving) is adopted is suppressed. In addition, as with the above-described first embodiment, the TFT occupied area can be reduced over conventional devices. By the above, an organic EL display device is implemented, in which picture-frame size is reduced over conventional devices while the occurrence of color breakup is suppressed.

3. Third Embodiment

3.1 Overall Configuration

Figure 26:
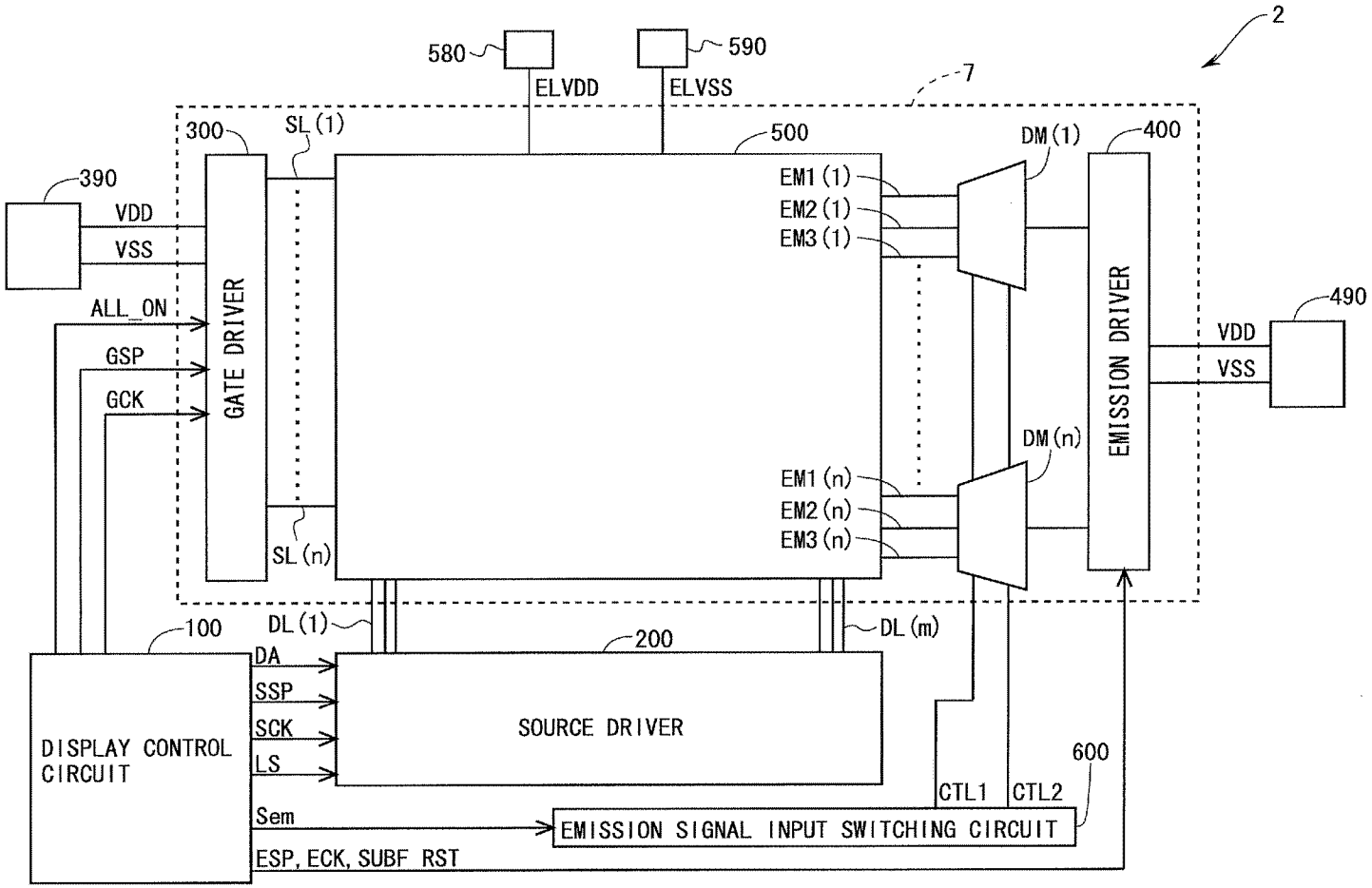
FIG. 26 is a block diagram showing an overall configuration of an active matrix-type organic EL display device according to a third embodiment of the present invention.

FIG. 26 is a block diagram showing an overall configuration of an active matrix-type organic EL display device 2 according to a third embodiment of the present invention. In the present embodiment, unlike the above-described first embodiment (see FIG. 2), one demultiplexer DM is provided for each row between an emission driver 400 and emission lines EM. That is, n demultiplexers DM(1) to DM(n) are provided overall. Two selection signals (a selection signal CTL1 and a selection signal CTL2) are provided to each demultiplexer DM from an emission signal input switching circuit 600. In the present embodiment, a second control signal generating unit is implemented by the emission signal input switching circuit 600, and a second control signal is implemented by the selection signal CTL1 and the selection signal CTL2. Note that in the present embodiment high-mobility transistors using LTPS (low-temperature polysilicon) or C—Si (crystalline silicon) are used.

3.2 Configuration and Operation of the Demultiplexers

Figure 27:
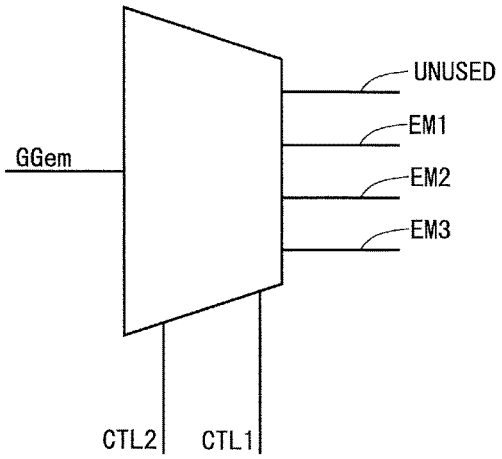
FIG. 27 is a diagram for describing input and output signals of a demultiplexer in the third embodiment.

FIG. 27 is a diagram for describing input and output signals of the demultiplexer DM in the present embodiment. As can be grasped from FIG. 27, the demultiplexer DM in the present embodiment is a one input/four output demultiplexer DM. A light-emission enable signal GGem which is outputted from the emission driver 400 is provided as an input signal to the demultiplexer DM. Then, the light-emission enable signal GGem is outputted to any one of the four output destinations based on selection signals CTL1 and CTL2. Three of the four output destinations are first to third emission lines EM1 to EM3. The remaining one is unused (an open terminal) in the present embodiment.

Figure 28:
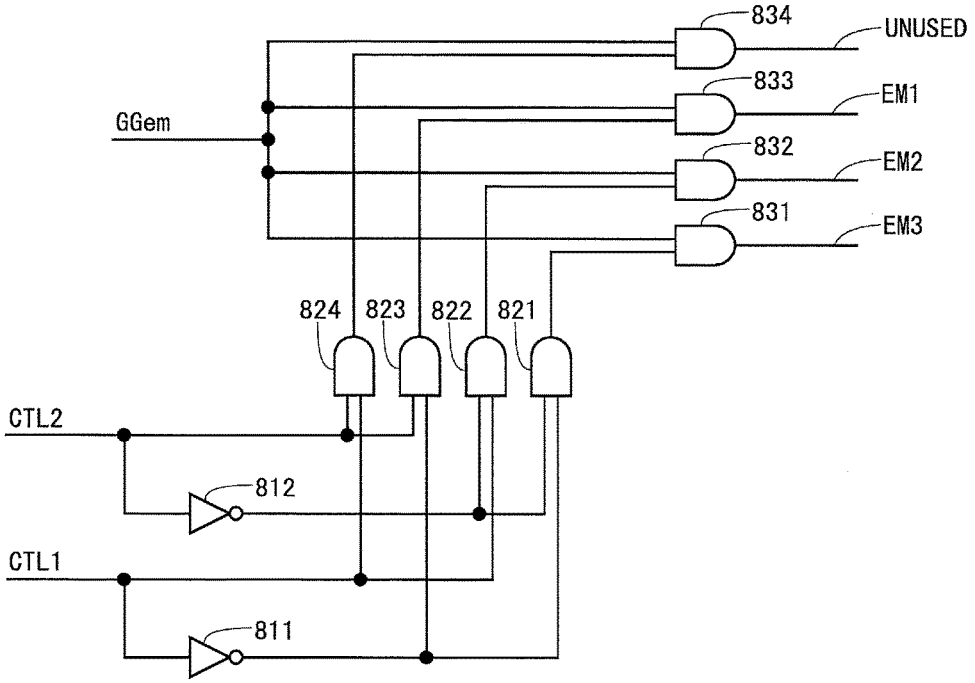
FIG. 28 is a block diagram showing a detailed configuration of the demultiplexer in the third embodiment.

FIG. 28 is a block diagram showing a detailed configuration of a demultiplexer DM in the present embodiment. Note that the demultiplexer DM is composed of a CMOS circuit. As shown in FIG. 28, the demultiplexer DM is composed of two NOT circuits 811 and 812 and eight AND circuits 821 to 824 and 831 to 834. The NOT circuit 811 outputs a logically inverted signal of the selection signal CTL1. The NOT circuit 812 outputs a logically inverted signal of the selection signal CTL2. The AND circuit 821 outputs a signal indicating an AND of the output signal from the NOT circuit 811 and the output signal from the NOT circuit 812. The AND circuit 822 outputs a signal indicating an AND of the selection signal CTL1 and the output signal from the NOT circuit 812. The AND circuit 823 outputs a signal indicating an AND of the output signal from the NOT circuit 811 and the selection signal CTL2. The AND circuit 824 outputs a signal indicating an AND of the selection signal CTL1 and the selection signal CTL2. The AND circuit 831 outputs a signal indicating an AND of the output signal from the AND circuit 821 and the light-emission enable signal GGem. The AND circuit 832 outputs a signal indicating an AND of the output signal from the AND circuit 822 and the light-emission enable signal GGem. The AND circuit 833 outputs a signal indicating an AND of the output signal from the AND circuit 823 and the light-emission enable signal GGem. The AND circuit 834 outputs a signal indicating an AND of the output signal from the AND circuit 824 and the light-emission enable signal GGem.

Figures 29, 30:
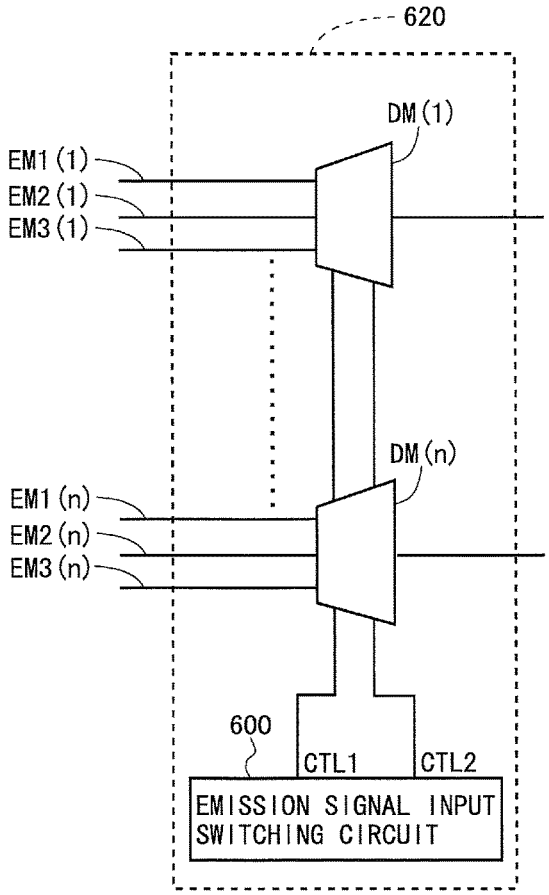
FIG. 29 is a diagram showing a correspondence relationship between selection signals and outputs in the demultiplexer in the third embodiment.
FIG. 30 is a diagram showing a configuration of a light-emission enable signal switching unit in the third embodiment.

Since the demultiplexer DM is configured in the above-described manner, a correspondence relationship between the selection signals and the outputs is such as that shown in FIG. 29. Therefore, when the value of the light-emission enable signal GGem is 1, if the value of the selection signal CTL1 is 0 and the value of the selection signal CTL2 is 0, then a first emission line EM1 goes into a selected state. In addition, when the value of the light-emission enable signal GGem is 1, if the value of the selection signal CTL1 is 1 and the value of the selection signal CTL2 is 0, then a second emission line EM2 goes into a selected state. Furthermore, when the value of the light-emission enable signal GGem is 1, if the value of the selection signal CTL1 is 0 and the value of the selection signal CTL2 is 1, then a third emission line EM3 goes into a selected state.

Meanwhile, if the value of the selection signal CTL1 is 1 and the value of the selection signal CTL2 is 1, then the light-emission enable signal GGem is not outputted to any of the emission lines EM. Therefore, even if the value of the light-emission enable signal GGem outputted from the emission driver 400 is 1, by setting both the value of the selection signal CTL1 and the value of the selection signal CTL2 to 1, the first to third emission lines EM1 to EM3 can be brought into a non-selected state.

Note that in the present embodiment, a light-emission enable signal switching unit 620 is implemented by the emission signal input switching circuit 600 and the demultiplexers DM(1) to DM(n) (see FIG. 30).

3.3 Drive Method

Figure 31:
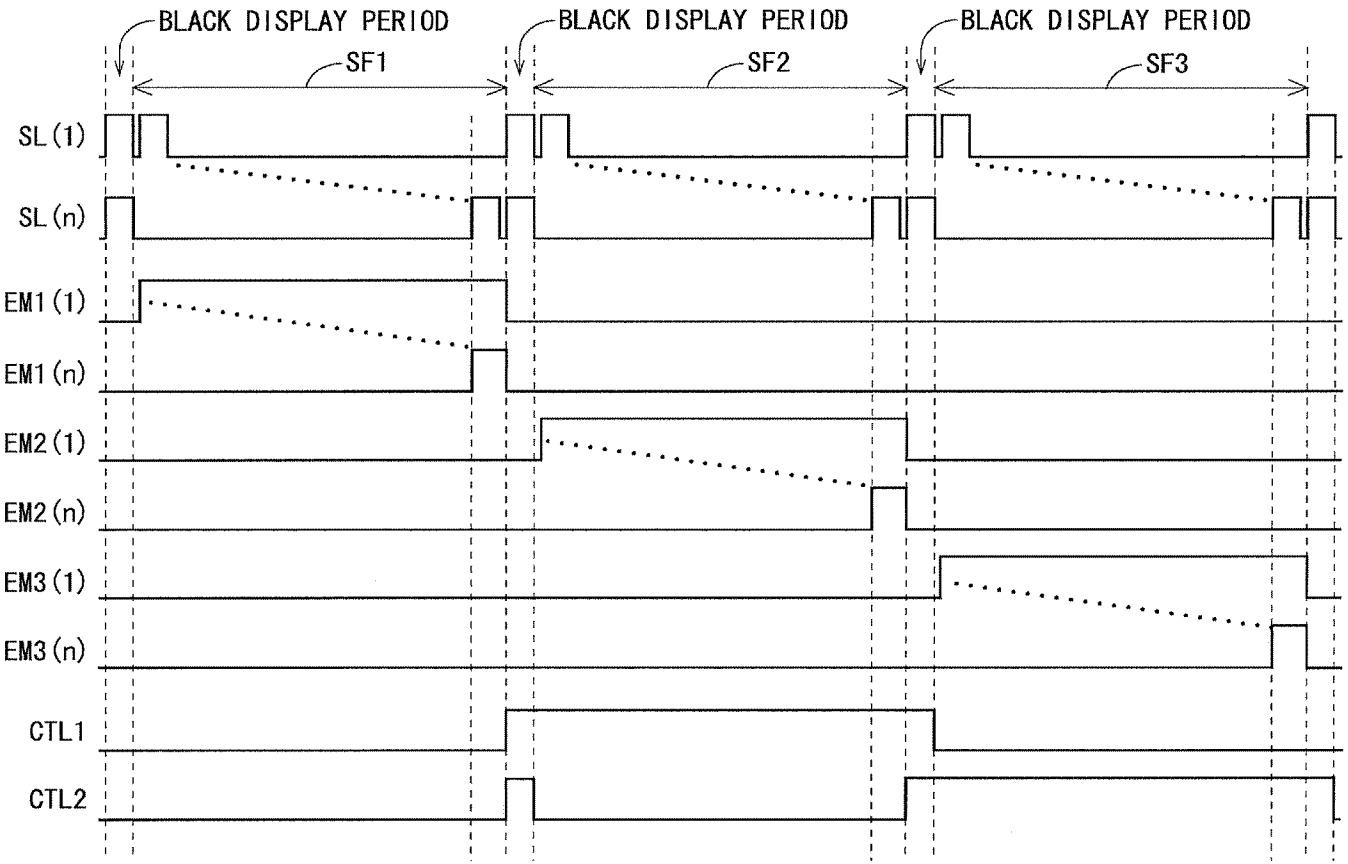
FIG. 31 is a timing chart showing the waveforms of scanning signals provided to scanning signal lines, light-emission enable signals provided to emission lines, and selection signals in the third embodiment.

Next, a drive method of the present embodiment will be described on the basis of the above-described operation of the demultiplexers DM. FIG. 31 is a timing chart showing the waveforms of scanning signals provided to scanning signal lines SL, light-emission enable signals provided to the emission lines EM, and selection signals CTL1 and CTL2. As with the above-described first embodiment, a flyback period between two consecutive subframes is a black display period. During the black display period, the value of the selection signal CTL1 is set to 1 and the value of the selection signal CTL2 is set to 1. By this, during the black display period, all the emission lines EM go into a non-selected state and all organic EL elements OLED in a display unit 500 go into a light-off state. Note that at the end time point of each subframe, the value of a light-emission enable signal GGem outputted from the emission driver 400 is set to 0 based on a subframe reset signal SUBF_RST. Therefore, it is not necessarily required to set both the value of the selection signal CTL1 and the value of the selection signal CTL2 to 1 during the black display period. However, by setting both the value of the selection signal CTL1 and the value of the selection signal CTL2 to 1, all the emission lines EM can be securely brought into a non-selected state during the black display period.

In a first subframe SF1, first, the emission signal input switching circuit 600 sets the value of the selection signal CTL1 to 0 and sets the value of the selection signal CTL2 to 0. By this, the output destination of the light-emission enable signal GGem to be inputted to the demultiplexers DM becomes the first emission lines EM1. Then, a gate driver 300 brings a scanning signal for the first row to a high level, and the emission driver 400 brings a light-emission enable signal for the first row to a high level. Since the output destination of the light-emission enable signal GGem is the first emission lines EM1, a first emission line EM1(1) goes into a selected state in the first row. By this, a transistor T3 goes into an on state and a transistor T4 and a transistor T5 go into an off state in each pixel circuit 50 in the first row. In addition, by a scanning signal line SL(1) in the first row going into a selected state, a transistor T2 goes into an on state in each pixel circuit 50 in the first row. As a result, in each pixel circuit 50 in the first row, a capacitor Cst is charged based on a data voltage applied to a corresponding data line DL.

When the gate driver 300 brings the scanning signal line SL(1) in the first row into anon-selected state, the transistor T2 goes into an off state in each pixel circuit 50 in the first row. By this, a gate-source voltage Vgs held in the capacitor Cst is fixed. In each pixel circuit 50 in the first row, a drive current according to the magnitude of the gate-source voltage Vgs flows between the drain and source of a transistor T1. Since the transistor T3 is in an on state in the first subframe SF1 as described above, the drive current is supplied to an organic EL element OLED(R) through the transistor T3 in each pixel circuit 50 in the first row. As a result, the organic EL element OLED(R) emits light in each pixel circuit 50 in the first row. Meanwhile, as described above, a pulse of the subframe reset signal SUBF_RST is provided to unit circuits 40 in a shift register 4 at the end time point of each subframe. Therefore, the first emission line EM1(1) in the first row is maintained in the selected state until the end time point of the first subframe SF1.

Operation such as that described above is sequentially performed for the second to nth rows. Furthermore, in a second subframe SF2 and a third subframe SF3, too, the same operation as that of the first subframe SF1 is performed. However, in the second subframe SF2, the emission signal input switching circuit 600 sets the value of the selection signal CTL1 to 1 and sets the value of the selection signal CTL2 to 0. In addition, in the third subframe SF3, the emission signal input switching circuit 600 sets the value of the selection signal CTL1 to 0 and sets the value of the selection signal CTL2 to 1. Therefore, second emission lines EM2 go into a selected state in the second subframe SF2, and third emission lines EM3 go into a selected state in the third subframe SF3.

3.4 Effects

According to the present embodiment, the demultiplexers DM that switch the output destination of the light-emission enable signal GGem outputted from the emission driver 400 among the first to third emission lines EM1 to EM3 are provided between the emission driver 400 and the emission lines EM (first to third emission lines EM1 to EM3). In such a configuration, switching of the output destination is performed every subframe. Hence, the light-emission enable signal GGem outputted from the emission driver 400 is supplied to different emission lines EM in different subframes. Therefore, unlike the conventional art, it is only necessary to provide an emission driver 400 for one system as a driver for generating a light-emission enable signal.

Figure 32:
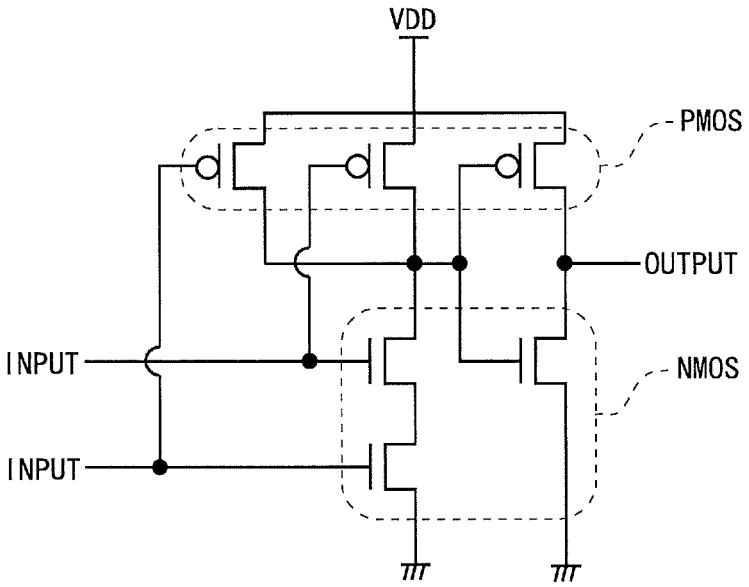
FIG. 32 is a circuit diagram showing a specific configuration of an AND circuit in the demultiplexer in the third embodiment.
Figure 33:
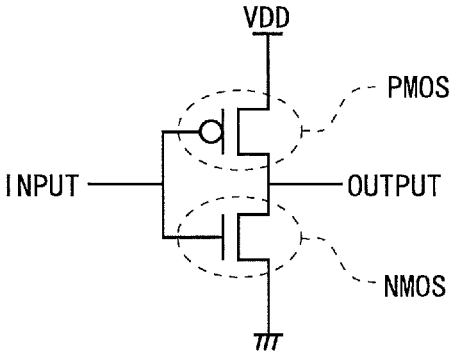
FIG. 33 is a circuit diagram showing a specific configuration of a NOT circuit in the demultiplexer in the third embodiment.

Meanwhile, as described above, the demultiplexers DM in the present embodiment each are composed of two NOT circuits 811 and 812 and eight AND circuits 821 to 824 and 831 to 834. When a CMOS circuit is used, each AND circuit is composed of six transistors (three NMOS transistors and three PMOS transistors) as shown in FIG. 32. In addition, when a CMOS circuit is used, each NOT circuit is composed of two transistors (one NMOS transistor and one PMOS transistor) as shown in FIG. 33. By the above, when the number of transistors required for one demultiplexer DM is P, P is determined as follows:

$$P = 6 \times 8 + 2 \times 2$$
$$= 52$$

Here, it is assumed that the number of transistors included in one stage of the shift register 4 composing the emission driver 400 is X. Since emission drivers 400 for three systems are required in the conventional art, the number of transistors for one row in the conventional art is "3X". On the other hand, the number of transistors for one row in the present embodiment is "X+52". By the above, when "3x>X+52" is satisfied, the number of transistors required is smaller in the present embodiment than in the conventional art. Therefore, if the number of transistors included in one stage of the shift register 4 is larger than 26, the TFT occupied area of the present embodiment is smaller than that of the conventional art.

As for viewpoints other than the TFT occupied area, an effect such as that shown below can be obtained according to the present embodiment. The demultiplexers DM in the present embodiment are composed of a CMOS circuit. Hence, even when the value of the light-emission enable signal GGem outputted from the emission driver 400 is 1, by controlling the values of selection signals CTL1 and CTL2 to be provided to the demultiplexers DM, all the emission lines EM can be promptly and forcibly brought into a non-selected state. By this, black insertion can be performed between two consecutive subframes at high speed. As a result, display quality for moving image display improves.

4. Fourth Embodiment

4.1 Overall Configuration

Figure 34:
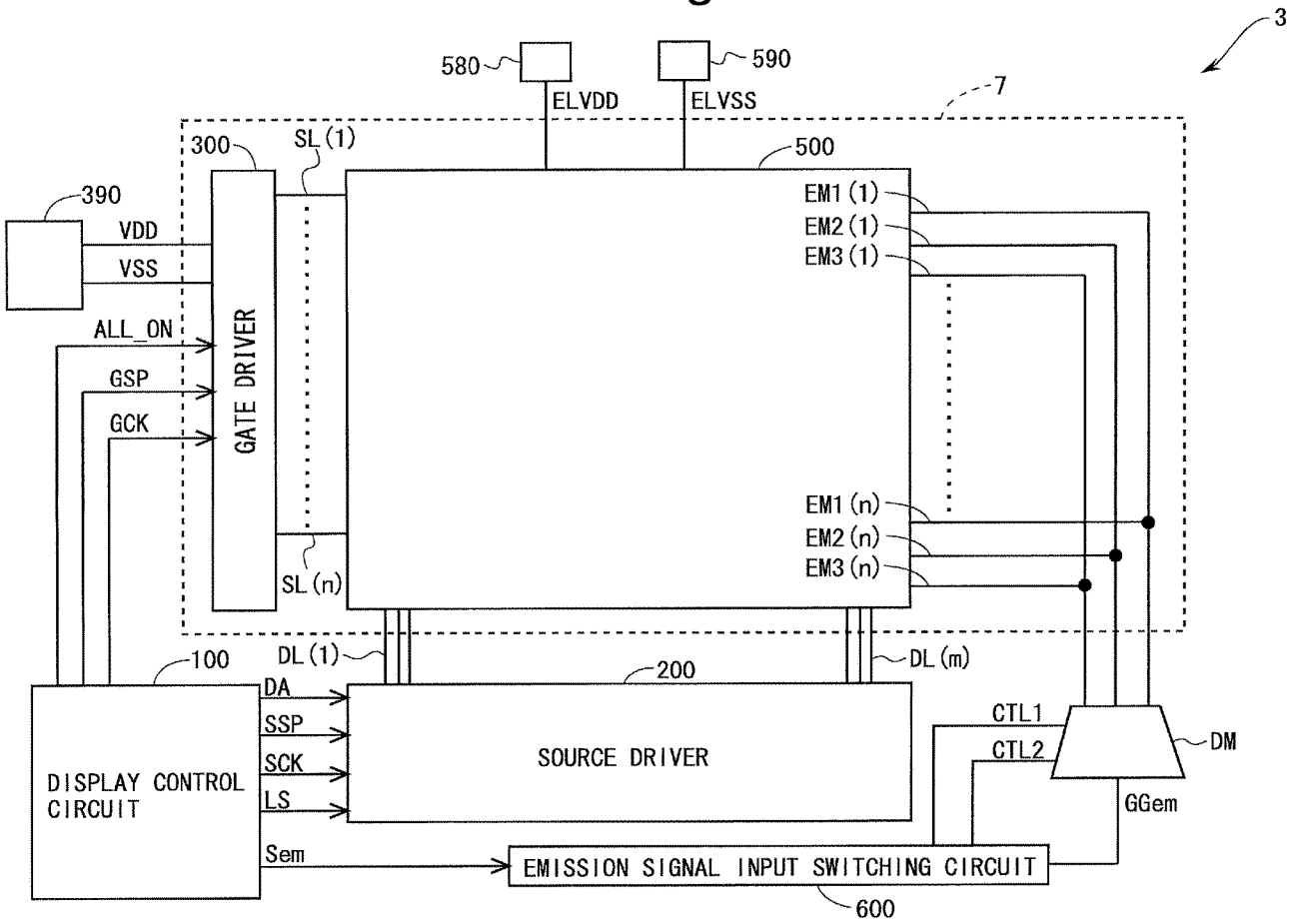
FIG. 34 is a block diagram showing an overall configuration of an active matrix-type organic EL display device according to a fourth embodiment of the present invention.

FIG. 34 is a block diagram showing an overall configuration of an active matrix-type organic EL display device 3 according to a fourth embodiment of the present invention. Although one demultiplexer DM is provided for each row in the above-described third embodiment, one demultiplexer DM is provided overall in the present embodiment. In addition, in the present embodiment, unlike the above-described first to third embodiments, an emission driver is not provided. An emission signal input switching circuit 600 provides two selection signals (a selection signal CTL1 and a selection signal CTL2) to the demultiplexer DM, and provides a light-emission enable signal GGem to the demultiplexer DM. Note that a light-emission enable signal generating unit is implemented by the emission signal input switching circuit 600 in the present embodiment.

4.2 Configuration and Operation of the Demultiplexer

The demultiplexer DM has the same configuration as that of the above-described third embodiment (see FIGS. 27 to 29). Therefore, one of the four outputs of the demultiplexer DM is unused. However, in the present embodiment, each of the remaining three outputs is connected to n emission lines EM as shown in FIG. 34. By the above, when the value of the light-emission enable signal GGem is 1, if the value of the selection signal CTL1 is 0 and the value of the selection signal CTL2 is 0, then first emission lines EM1(1) to EM1(*n*) in the first to nth rows go into a selected state. In addition, when the value of the light-emission enable signal GGem is 1, if the value of the selection signal CTL1 is 1 and the value of the selection signal CTL2 is 0, then second emission lines EM2(1) to EM2(*n*) in the first to nth rows go into a selected state. Furthermore, when the value of the light-emission enable signal GGem is 1, if the value of the selection signal CTL1 is 0 and the value of the selection signal CTL2 is 1, then third emission lines EM3(1) to EM3 (*n*) in the first to nth rows go into a selected state. If the value of the selection signal CTL1 is 1 and the value of the selection signal CTL2 is 1, then regardless of the value of the light-emission enable signal GGem, all the emission lines EM go into a non-selected state. Note that a light-emission enable signal switching unit is implemented by the emission signal input switching circuit 600 and the demultiplexer DM in the present embodiment.

4.3 Drive Method

Figure 35:
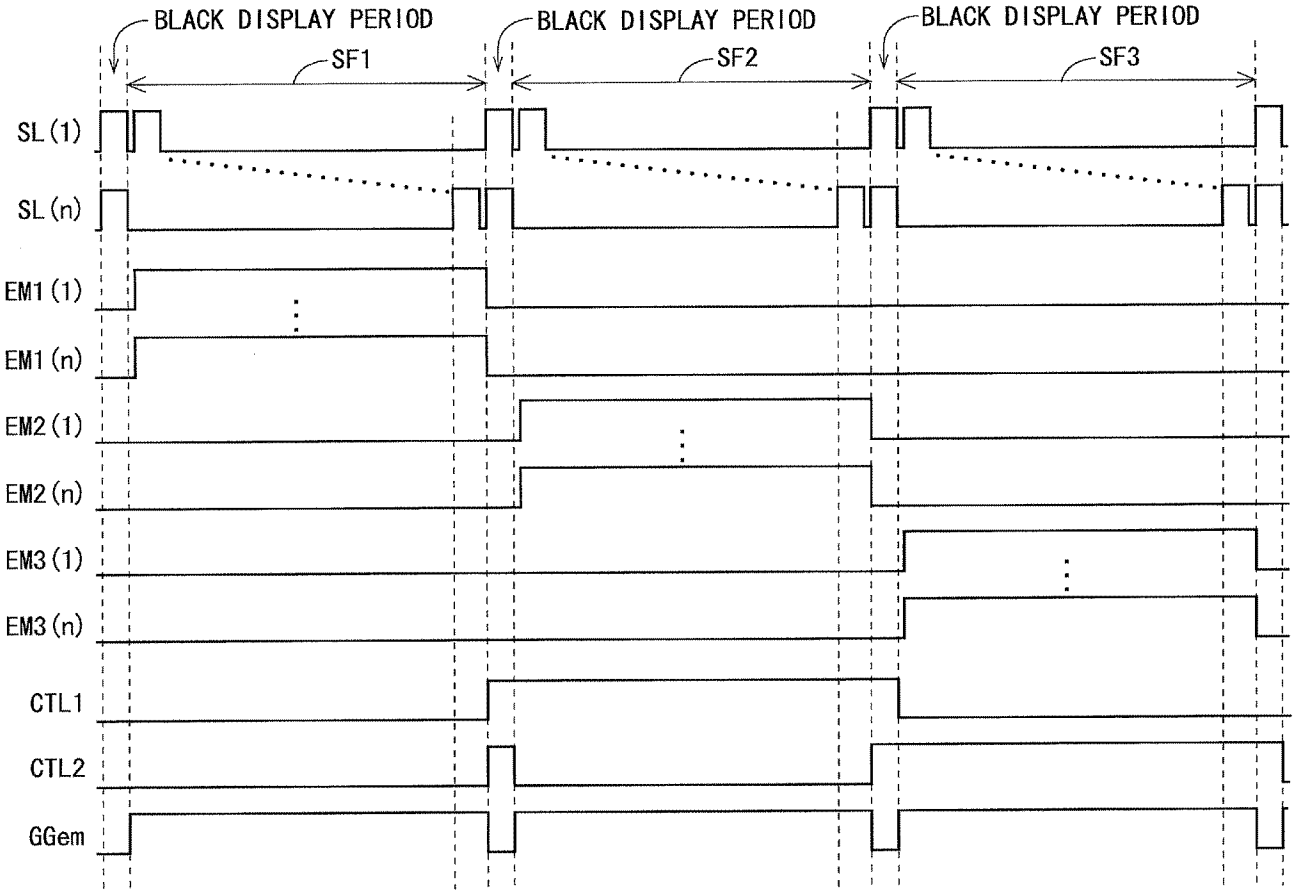
FIG. 35 is a timing chart showing the waveforms of scanning signals provided to scanning signal lines, light-emission enable signals provided to emission lines, selection signals, and a light-emission enable signal outputted from an emission signal input switching circuit 600 in the fourth embodiment.

Next, a drive method of the present embodiment will be described. FIG. 35 is a timing chart showing the waveforms of scanning signals provided to scanning signal lines SL, light-emission enable signals provided to the emission lines EM, selection signals CTL1 and CTL2, and a light-emission enable signal outputted from the emission signal input switching circuit 600. As can be grasped from FIG. 35, the value of the light-emission enable signal outputted from the emission signal input switching circuit 600 is set to 0 during black display periods and set to 1 during other periods.

As with the above-described first embodiment, a flyback period between two consecutive subframes is a black display period. During the black display period, the value of the selection signal CTL1 is set to 1 and the value of the selection signal CTL2 is set to 1. By this, during the black display period, all the emission lines EM go into a non-selected state and all organic EL elements OLED in a display unit 500 go into a light-off state. Note that since the value of the light-emission enable signal GGem outputted from the emission signal input switching circuit 600 is set to 0 during the black display period, it is not necessarily required to set both the value of the selection signal CTL1 and the value of the selection signal CTL2 to 1 during the black display period. However, by setting both the value of the selection signal CTL1 and the value of the selection signal CTL2 to 1, all the emission lines EM can be securely brought into a non-selected state during the black display period.

In a first subframe SF1, first, the emission signal input switching circuit 600 sets the value of the selection signal CTL1 to 0 and sets the value of the selection signal CTL2 to 0. By this, the output destination of the light-emission enable signal GGem to be inputted to the demultiplexer DM becomes the first emission lines EM1. In addition, the value of the light-emission enable signal GGem outputted from the emission signal input switching circuit 600 is set to 1 throughout the period of the first subframe SF1. By this, the first emission lines EM1(1) to EM1(*n*) in the first to nth rows go into a selected state throughout the period of the first subframe SF1. By this, in each pixel circuit 50 in all rows, a transistor T3 goes into an on state and a transistor T4 and a transistor T5 go into an off state. In such a state, a gate driver 300 first brings a scanning signal for the first row to a high level. By this, a transistor T2 goes into an on state in each pixel circuit 50 in the first row. As a result, a capacitor Cst is charged based on a data voltage applied to a corresponding data line DL in each pixel circuit 50 in the first row.

When the gate driver 300 brings a scanning signal line SL(1) in the first row into a non-selected state, the transistor T2 goes into an off state in each pixel circuit 50 in the first row. By this, a gate-source voltage Vgs held in the capacitor Cst is fixed. In each pixel circuit 50 in the first row, a drive current according to the magnitude of the gate-source voltage Vgs flows between the drain and source of a transistor T1. As described above, the transistor T3 is in an on state in the first subframe SF1. As a result, in each pixel circuit 50 in the first row, the drive current is supplied to an organic EL element OLED(R) through the transistor T3, and thus, the organic EL element OLED(R) emits light.

Operation such as that described above is sequentially performed for the second to nth rows. Furthermore, in a second subframe SF2 and a third subframe SF3, too, the same operation as that of the first subframe SF1 is performed. However, in the second subframe SF2, the emission signal input switching circuit 600 sets the value of the selection signal CTL1 to 1 and sets the value of the selection signal CTL2 to 0. In addition, in the third subframe SF3, the emission signal input switching circuit 600 sets the value of the selection signal CTL1 to 0 and sets the value of the selection signal CTL2 to 1. Therefore, the second emission lines EM2 go into a selected state in the second subframe SF2, and the third emission lines EM3 go into a selected state in the third subframe SF3.

Note that the n emission lines EM are maintained in a selected state throughout the period from the start time point to end time point of each subframe in the present embodiment. However, writing of image data corresponding to a black color is performed during the black display periods (flyback periods) as described above, and thus, the organic EL elements OLED do not emit light at luminance determined according to writing performed in the preceding subframe in each subframe.

4.4 Effect

According to the present embodiment, there is provided a demultiplexer DM with four outputs, three of which are connected to all the first emission lines EM1, all the second emission line EM2, and all the third emission lines EM3, respectively. In such a configuration, switching of output is performed every subframe. Hence, a light-emission enable signal GGem inputted to the demultiplexer DM is supplied to different emission lines EM in different subframes. In this manner, the states (selected state/non-selected state) of all the emission lines EM can be controlled based on one light-emission enable signal GGem. By controlling the states of all the emission lines EM from outside of an organic EL panel 7 using a CMOS logic IC in this manner, an emission driver which is formed using a shift register in the organic EL panel 7 becomes unnecessary. By the above, the number of transistors required to control the light emission of the organic EL elements OLED is significantly reduced over conventional devices.

Next, an effect of the present embodiment will be quantitatively described. Note that, here, an FHD display device with 1080 rows×1920 columns is considered. According to the conventional art, emission drivers 400 for three systems are required, and six transistors M1 to M6 are required for an emission driver 400 for one system as can be grasped from FIG. 12. Therefore, 18 transistors are required for one row. Hence, according to the conventional art, in the case of the FHD display device, 34560 transistors are required. On the other hand, according to the present embodiment, it is only necessary to provide one demultiplexer DM. As described above, one demultiplexer DM requires 52 transistors. Thus, according to the present embodiment, 52 transistors are required.

Figure 36:
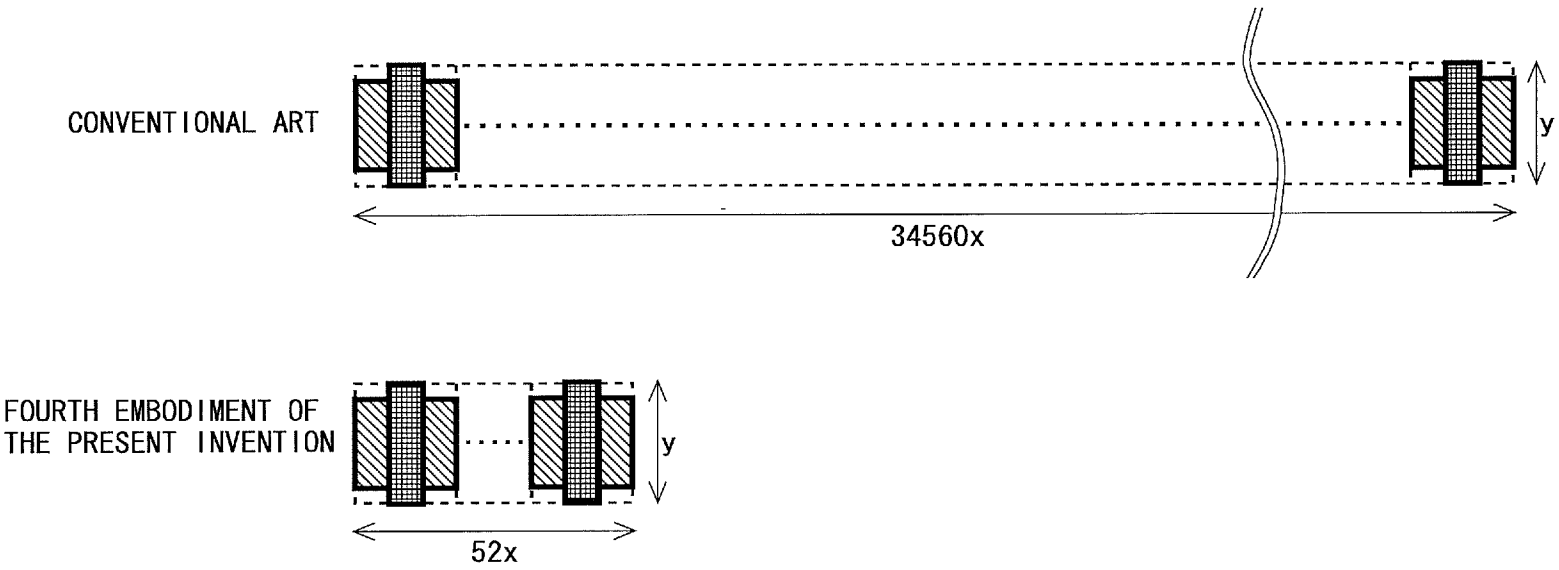
FIG. 36 is a diagram for describing an effect of the fourth embodiment.
Figure 37:
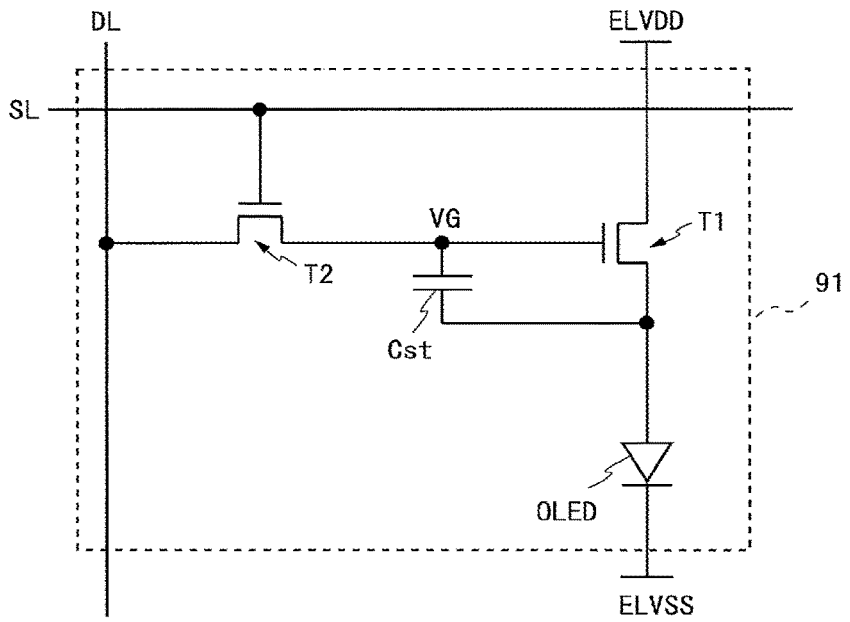
PRIOR ART Fig.37
FIG. 37 is a circuit diagram showing a configuration of a conventional general pixel circuit forming one subpixel.
Figure 38:
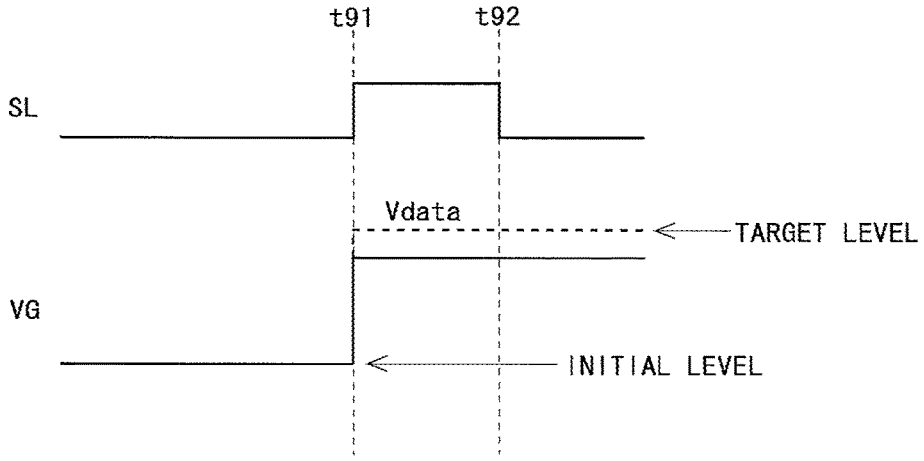
PRIOR ART Fig.38
FIG. 38 is a timing chart for describing the operation of the pixel circuit shown in FIG. 37.
Figure 39:
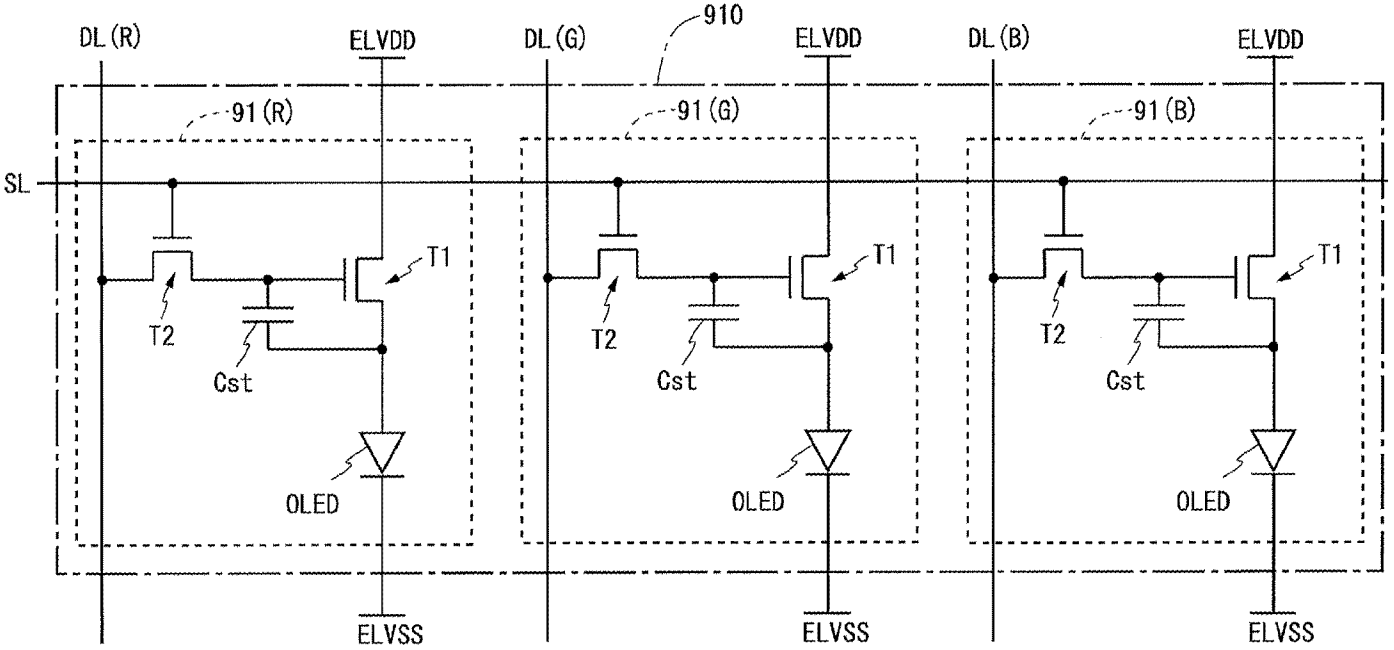
PRIOR ART Fig.39
FIG. 39 is a circuit diagram showing a configuration of a pixel circuit corresponding to one pixel in a conventional example.
Figure 40:
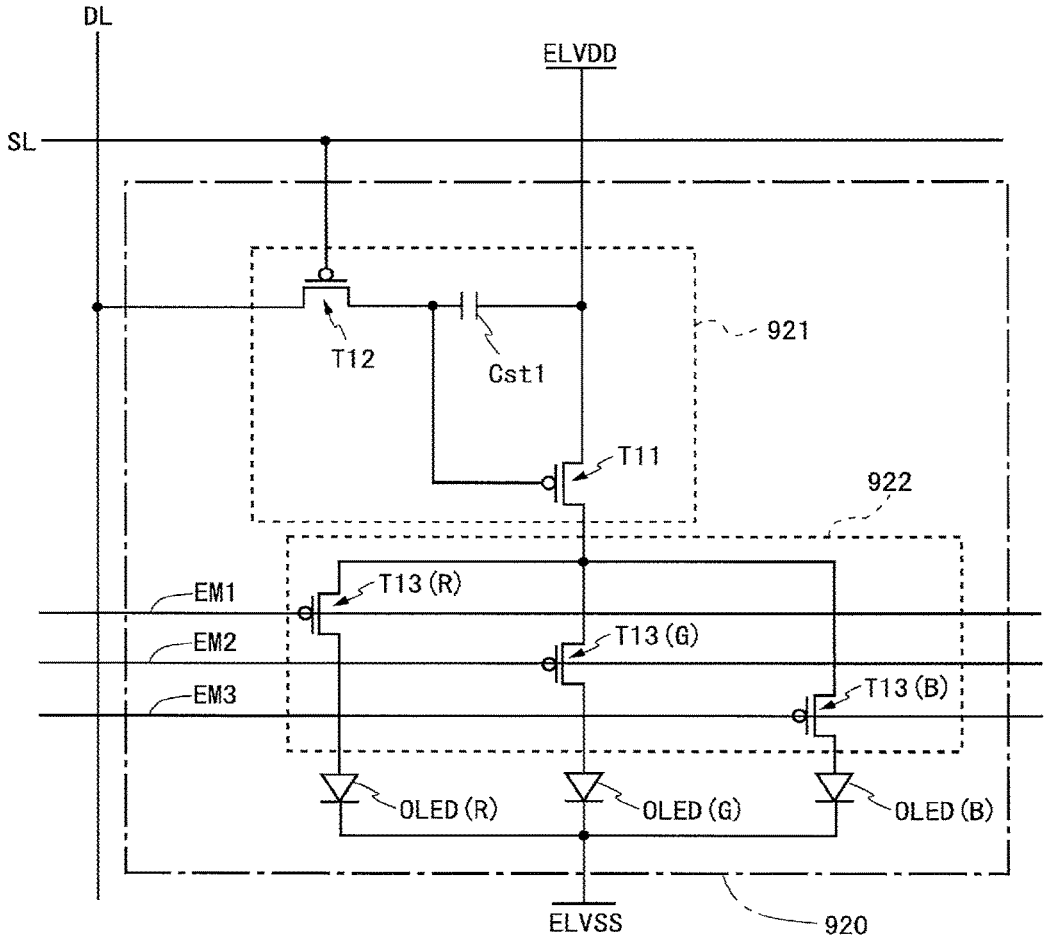
PRIOR ART Fig.40
FIG. 40 is a circuit diagram showing a configuration of a pixel circuit corresponding to one pixel in an example disclosed in Japanese Patent Application Laid-Open No. 2005-148749.

By the above, in the case of the FHD display device, as shown in FIG. 36, while the TFT occupied area of the conventional art is 34560xy, the TFT occupied area of the present embodiment is 52xy. Therefore, the ratio of the TFT occupied area of the present embodiment to the TFT occupied area of the conventional art (TFT occupied area ratio) P3 is as follows:

$$P3 = (52xy / 34560xy) \times 100$$
$$= 0.15(\%)$$

That is, according to the present embodiment, for example, in the case of the FHD display device, the TFT occupied area is 0.15 percent compared to that of the conventional art. As such, according to the present embodiment, the TFT occupied area is significantly reduced compared to that of the conventional art. Therefore, since the picture-frame size of an organic EL display device can be reduced over conventional devices, miniaturization of the organic EL display device is achieved.

5. Others

The present invention is not limited to the above-described embodiments and variants, and may be implemented by making various modifications thereto without departing from the true scope and spirit of the present invention. For example, although the above-described embodiments and variants have been described taking the organic EL display device as an example, the present invention can also be applied to display devices other than organic EL display devices as long as the display devices include self light-emitting type display elements which are driven by a current.

In addition, although n-channel transistors are used as transistors in the pixel circuits 50 (see FIG. 7), etc. in the above-described embodiments and variants, p-channel transistors may be used.

DESCRIPTION OF REFERENCE CHARACTERS

1 to 3: ORGANIC EL DISPLAY DEVICE
4: SHIFT REGISTER
7: ORGANIC EL PANEL
50: PIXEL CIRCUIT
100: DISPLAY CONTROL CIRCUIT
200: SOURCE DRIVER
300: GATE DRIVER
400: EMISSION DRIVER
500: DISPLAY UNIT
510: DRIVE CURRENT CONTROL UNIT
600: EMISSION SIGNAL INPUT SWITCHING CIRCUIT
610 and 620: LIGHT-EMISSION ENABLE SIGNAL SWITCHING UNIT
DM and DM(1) to DM(n): DEMULTIPLEXER
T1: DRIVE TRANSISTOR
T2: INPUT TRANSISTOR
T3 to T6: LIGHT-EMISSION CONTROL TRANSISTOR Tem1 to Tem4: LIGHT-EMISSION ENABLE SIGNAL SUPPLY CONTROL TRANSISTOR Cst: CAPACITOR

OLED(R): RED-COLOR ORGANIC EL ELEMENT (ELECTRO-OPTICAL ELEMENT)

OLED(G): GREEN-COLOR ORGANIC EL ELEMENT (ELECTRO-OPTICAL ELEMENT)

OLED(B): BLUE-COLOR ORGANIC EL ELEMENT (ELECTRO-OPTICAL ELEMENT)

DL and DL(1) to DL (m): DATA LINE

SL and SL(1) to SL (n): SCANNING SIGNAL LINE

EM: EMISSION LINE

EM1 and EM1(1) to EM1(*n*): FIRST EMISSION LINE

EM2 and EM2(1) to EM2 (*n*): SECOND EMISSION LINE

EM3 and EM3(1) to EM3 (*n*): THIRD EMISSION LINE

ELVDD: HIGH-LEVEL POWER SUPPLY VOLTAGE AND HIGH-LEVEL POWER SUPPLY LINE

ELVSS: LOW-LEVEL POWER SUPPLY VOLTAGE AND LOW-LEVEL POWER SUPPLY LINE

The invention claimed is:

1. An active matrix-type display device that performs color image display by dividing one frame period into j subframes (j is an integer greater than or equal to 3) and displaying different color screens in different subframes, the active matrix-type display device comprising:

pixel circuits arranged in a matrix form so as to form a plurality of rows and a plurality of columns, each of the pixel circuits including: j electro-optical elements configured to emit light of different colors respectively; a drive current control unit configured to control a drive current for bringing the j electro-optical elements into a light-emitting state; and j light-emission control transistors configured to control supply of the drive current to their corresponding electro-optical elements, the j light-emission control transistors being provided in a one-to-one correspondence with the j electro-optical elements;

a light-emission enable signal generating unit configured to generate a light-emission enable signal for controlling on/off states of the j light-emission control transistors;

j light-emission control lines provided for each row, the j light-emission control lines being configured to supply the light-emission enable signal to the j light-emission control transistors;

a light-emission enable signal switching unit configured to switch a supply destination of the light-emission enable signal among the j light-emission control lines in each row, such that the light-emission enable signal is supplied to different light-emission control lines in different subframes, the light-emission enable signal being generated by the light-emission enable signal generating unit; and a unit circuit;

wherein the light-emission enable signal switching unit includes:

a first control signal generating unit configured to generate a first control signal; and j light-emission enable signal supply control transistors provided for each row in a one-to-one correspondence with the j light-emission control lines, wherein the first control signal is provided to control terminals of the j light-emission enable signal supply control transistors, first conduction terminals of the j light-emission enable signal supply control transistors are connected to the light-emission enable signal generating unit, second conduction terminals of the j light-emission enable signal supply control transistors are connected to their corresponding light-emission control lines, the first control signal generating unit generates the first control signal such that one of the j light-emission enable signal supply control transistors goes into an on state in each subframe, and each of the j light-emission enable signal supply control transistors goes into an on state once during one frame period;

wherein the light-emission enable signal generating unit includes a shift register having a plurality of stages, the shift register outputs the light-emission enable signals to the plurality of rows based on a plurality of clock signals inputted from an external source, the light-emission enable signals sequentially going to an on level;

wherein the unit circuit forming each of the stages of the shift register includes:

a first node;

a first output node configured to output an other-stage control signal that controls operation of a unit circuit of a different stage;

a second output node configured to output the light-emission enable signal;

a first transistor having: a control terminal to which the other-stage control signal outputted from a unit circuit of a previous stage is provided; a first conduction terminal to which the other-stage control signal is provided; and a second conduction terminal connected to the first node;

a second transistor having: a control terminal connected to the first node; a first conduction terminal to which one of the plurality of clock signals is provided; and a second conduction terminal connected to the first output node;

a third transistor having: a control terminal connected to the first node; a first conduction terminal to which an on-level direct-current power supply voltage is provided; and a second conduction terminal connected to the second output node;

a fourth transistor having: a control terminal to which the other-stage control signal outputted from a unit circuit of a subsequent stage is provided; a first conduction terminal connected to the first output node; and a second conduction terminal to which an off-level direct-current power supply voltage is provided;

a fifth transistor having: a control terminal to which the other-stage control signal outputted from the unit circuit of the subsequent stage is provided; a first conduction terminal connected to the first node; and a second conduction terminal to which an off-level direct-current power supply voltage is provided; and a sixth transistor having: a control terminal to which a subframe reset signal is provided, the subframe reset signal going to an on level at an end time point of each subframe; a first conduction terminal connected to the second output node; and a second conduction terminal to which an off-level direct-current power supply voltage is provided;

wherein in each unit circuit, by the other-stage control signal outputted from a unit circuit of a previous stage going to an on level, the first transistor goes into an on state and the first node goes to an on level, thereafter, by the first node going to a stronger on level due to the clock signal provided to the first conduction terminal of the second transistor going to an on level, the third transistor goes into an on state and the on-level direct-current power supply voltage is provided to the second output node, thereafter, by the subframe reset signal going to an on level at an end time point of the subframe, the sixth transistor goes into an on state and the off-level direct-current power supply voltage is provided to the second output node, the light-emission enable signal is in an on level when the on-level direct-current power supply voltage is provided to the second output node; and wherein in each subframe, the light-emission enable signal having gone to an on level is maintained at the on level until an end time point of the subframe, in all of the plurality of rows, and the closer the stage corresponding to the row of the supply destination of the light-emission enable signal is to the final stage of the shift register, the shorter the period during which the light-emission enable signal is maintained at the on level.

2. The display device according to claim 1, wherein the j light-emission control transistors and the j light-emission enable signal supply control transistors are thin-film transistors each having a channel layer formed of an oxide semiconductor.

3. The display device according to claim 2, wherein main components of the oxide semiconductor are indium (In), gallium (Ga), zinc (Zn), and oxygen (O).

4. The display device according to claim 1, wherein when j pixel circuits are defined as one group, and j pixel circuits included in each group and j light-emission control lines corresponding to the j pixel circuits are focused, each of the focused j light-emission control lines is connected to light-emission control transistors corresponding to electro-optical elements that are configured to emit light of different colors in the focused j pixel circuits.

5. The display device according to claim 1, further comprising:

scanning signal lines provided for the respective rows;

data lines provided for the respective columns;

a first power supply line configured to supply a high-level direct-current power supply voltage to the pixel circuits; and a second power supply line configured to supply a low-level direct-current power supply voltage to the pixel circuits, wherein the drive current control unit includes:

a drive transistor configured to control the drive current, the drive transistor being provided between the first power supply line and the second power supply line and in series with each of the j light-emission control transistors;

an input transistor configured to electrically connect a control terminal of the drive transistor to a corresponding data line when a corresponding scanning signal line is brought into a selected state, the input transistor being provided between the control terminal of the drive transistor and the corresponding data line; and a capacitor provided between the control terminal of the drive transistor and one conduction terminal of the drive transistor.

6. The display device according to claim 1, wherein a black display period during which the j electro-optical elements included in each of the pixel circuits are brought into a light-off state and image data corresponding to a black color is written to the pixel circuits is provided between two consecutive subframes.

7. A method for driving the display device according to claim 1.

* * * * *